US006962898B2

(12) United States Patent
Kessler et al.

(10) Patent No.: US 6,962,898 B2
(45) Date of Patent: Nov. 8, 2005

(54) MACHINE DISHWASHER RINSING AGENT

(75) Inventors: Arnd Kessler, Leverkusen (DE); Rolf Bayersdoerfer, Duesseldorf (DE); Rainer Sorg, Kempen (DE); Christian Nitsch, Duesseldorf (DE); Melanie Baumann, Duisburg (DE)

(73) Assignee: Henkel Kommanditgesellschaft auf Aktien, Dusseldorf (DE)

( * ) Notice: Subject to any disclaimer, the term of this patent is extended or adjusted under 35 U.S.C. 154(b) by 56 days.

(21) Appl. No.: 10/332,328

(22) PCT Filed: Jun. 28, 2001

(86) PCT No.: PCT/EP01/07383

§ 371 (c)(1),
(2), (4) Date: Jan. 7, 2003

(87) PCT Pub. No.: WO02/04583

PCT Pub. Date: Jan. 17, 2002

(65) Prior Publication Data

US 2003/0158064 A1 Aug. 21, 2003

(30) Foreign Application Priority Data

Jul. 7, 2000 (DE) ..... 100 32 612
Oct. 12, 2000 (DE) ..... 100 50 622

(51) Int. Cl.[7] ..... C11D 1/66; C11D 3/04; C11D 3/34; C11D 3/37; C11D 3/43

(52) U.S. Cl. ..... 510/223; 510/229; 510/230; 510/434; 510/476; 510/477; 510/514; 510/521; 510/533

(58) Field of Search ..... 510/223, 229, 510/230, 434, 476, 477, 514, 521, 533

(56) References Cited

U.S. PATENT DOCUMENTS

| | | | |
|---|---|---|---|
| 5,780,420 | A | 7/1998 | Breuer et al. |
| 5,958,855 | A | 9/1999 | Binstock et al. |
| 6,075,001 | A | 6/2000 | Wilde |

FOREIGN PATENT DOCUMENTS

| | | | | | |
|---|---|---|---|---|---|
| DE | 44 00 024 | A1 | | 7/1995 | |
| DE | 196 16 693 | A1 | | 11/1997 | |
| DE | 196 16 767 | A1 | | 11/1997 | |
| EP | 0 182 600 | A2 | | 5/1986 | |
| EP | 0 197 434 | B1 | | 7/1989 | |
| EP | 0 851 022 | A2 | | 7/1998 | |
| EP | 851022 | | * | 7/1998 | ..... C11D/3/37 |
| EP | 0 851 024 | A2 | | 7/1998 | |
| WO | WO 01/72941 | A1 | | 10/2001 | |

OTHER PUBLICATIONS

Rompp, Tensiometer, 9$^{th}$ Edition, vol. 6, p. 4440, Verlag Stuttgart, New York, not translated; no date given.

Voight, Lehrbuch der phamazeutischen Technologie, 6$^{th}$ Edition, pp. 182–184 (1987), not translated; no month given.

* cited by examiner

*Primary Examiner*—Brian P. Mruk
(74) *Attorney, Agent, or Firm*—Stephen D. Harper; Glenn E. J. Murphy

(57) ABSTRACT

Detergents for dishwashing contain 1% up to 98.8% by weight of builders, 0.1% to 70% by weight of copolymers of unsaturated carboxylic acids and monomers containing sulfonic acid groups, and one or both of 5% to 30% by weight of nonionic surfactants and 0.1% to 30% by weight of homo- or copolymeric polycarboxylic acids or salts thereof.

52 Claims, No Drawings

MACHINE DISHWASHER RINSING AGENT

CROSS-REFERENCE TO RELATED APPLICATIONS

This application is a U.S. National Stage application filed under 35 U.S.C. § 371, claiming priority under 35 U.S.C. § 365 of International Application No. PCT/EP01/07383, filed Jun. 28, 2001 in the European Patent Office, and claiming priority under 35 U.S.C. § 119 of DE 100 32 612.9, filed Jul. 7, 2000, and DE 100 50 622.4, filed Oct. 12, 2000 in the German Patent Office.

BACKGROUND OF THE INVENTION

This invention relates to detergents for dishwashing machines (dishwasher detergents) which contain polymers bearing sulfonic acid groups and, in addition, have another beneficial effect. The polymers containing sulfonic acid groups are copolymers of i) unsaturated carboxylic acids, ii) monomers containing sulfonic acid groups and iii) optionally other ionic or nonionic monomers. The detergents may be formulated as solids or liquids, for example as powders, granules, extrudates, tablets, liquids or gels.

Today, machine-washed tableware has to meet stricter requirements than hand-washed tableware. Thus, even tableware completely free from food residues is regarded as unsatisfactory when, after dishwashing, it still has whitish stains which are attributable to water hardness or other mineral salts and which come from water droplets that have remained on the tableware through lack of wetting agent and dried.

Accordingly, to obtain bright, spotless tableware, rinse agents are now successfully used. The addition of rinse agent at the end of the wash program ensures that the water drains completely from the tableware so that the various surfaces are bright and free from residues at the end of the dishwashing program.

The cleaning of tableware in domestic dishwashing machines normally comprises a prerinse cycle, a main wash cycle and a final rinse cycle which are interrupted by intermediate rinse cycles. With most machines, the prerinse cycle can be selected for heavily soiled tableware, but is only selected by the consumer in exceptional cases so that, in most machines, a main wash cycle, an intermediate rinse cycle with clean water and a final rinse cycle are carried out. The temperature of the main wash cycle varies between 40 and 65° C., according to the type of machine and the program selected. In the final rinse cycle, rinse aids which normally contain nonionic surfactants as their main constituent are added from a dosing tank. These rinse aids are liquids and are widely described in the prior art. Their principal function is to prevent lime stains and bloom on the cleaned tableware. Besides water and low-foaming nonionic surfactants, many rinse aids often contain hydrotropes, pH regulators, such as citric acid, or bloom-inhibiting polymers.

EP-B1 0 197 434 (Henkel) describes liquid rinse agents which contain mixed ethers as nonionic surfactants. A wide variety of materials (glass, metal, silver, plastic, china) is cleaned in dishwashers. These various materials have to be thoroughly wetted in the final rinse cycle. Rinse agent formulations containing only mixed ethers as their surfactant component satisfy these requirements inadequately, if at all, so that the clear rinse effect or drying effect is unsatisfactory, particularly on plastic surfaces.

The storage tank in the dishwashing machine has to be filled with rinse agent at regular intervals, one filling being enough for 10 to 50 rinse cycles according to the type of machine. If the consumer forgets to fill the tank, glasses in particular are spoiled by lime stains and bloom. Accordingly, some proposals have been put forward in the prior art with a view to integrating a rinse agent in dishwasher detergents. These proposed solutions are confined to tablets.

Thus, European patent application EP-A-0 851 024 (Unilever) describes two-layer detergent tablets of which the first layer contains peroxy bleaching agent, builder and enzyme while the second layer contains an acidifying agent, a continuous medium with a melting point of 55 to 70° C. and bloom inhibitors. The high-melting continuous medium is said to release the acid(s) and bloom inhibitor(s) with delay and to develop a clear rinse effect. Powder-form dishwasher detergents or surfactant-containing rinse agent systems are not mentioned in this document.

The problem addressed by the present invention was to provide new dishwasher detergents which would at least match commercially available detergents in their performance properties and which, in addition, would afford other performance-related advantages. The new detergents would be usable both as conventional detergents and in the form of combination products and would develop their favorable properties irrespective of their supply form.

It has now been found that the use of polymers containing sulfonic acid groups in dishwasher detergents has advantageous effects if, in addition to the polymers containing sulfonic acid groups, the detergents contain large quantities of nonionic surfactants. With detergents according to the invention of this embodiment, the quantities of surfactant remaining in the machine after the main wash cycle and the intermediate rinses provide for adequate drainage behavior in the final rinse cycle so that the water running off the tableware does not leave any stains behind on drying. Where these detergents according to the invention are used, the final rinse cycle does not have to be charged with additional, intentionally added rinse agents.

DESCRIPTION OF THE INVENTION

Accordingly, in a first embodiment, the present invention relates to dishwasher detergents which contain a) 1 to 94.9% by weight builder(s), b) 0.1 to 70% by weight copolymers of i) unsaturated carboxylic acids, ii) monomers containing sulfonic acid groups, iii) optionally other ionic or nonionic monomers, c) 5 to 30% by weight nonionic surfactant(s), the quantities shown being based on the detergent as a whole.

As explained in detail hereinafter, these detergents can be made up in every conceivable supply form, for example as liquid or gel-form detergents, as powders, granules, extrudates, flakes, pellets or in the form of blocks or tablets. Where the detergents are made up as tablets, both single-phase and multiphase tablets can be produced. In the case of multiphase (for example multilayer) tablets, the quantities shown above may be based on a single phase (layer) while the other phase(s) have a different composition. It is possible in this way to obtain multifunctional systems which, for example, combine a quick-dissolving pre-cleaning layer with a basic tablet having the composition according to the invention.

Besides the combination of polymers containing sulfonic acid groups with nonionic surfactants in large quantities, detergents containing other homo- and/or copolymeric polycarboxylic acids or polycarboxylates in addition to the copolymers b) have proved to be particularly suitable.

Accordingly, in another embodiment, the present invention relates to dishwasher detergents which contain a) 1 to 98.8% by weight builder(s), b) 0.1 to 70% by weight copolymers of i) unsaturated carboxylic acids, ii) monomers containing sulfonic acid groups, iii) optionally other ionic or nonionic monomers, c) 0.1 to 30% by weight homo- and/or copolymeric polycarboxylic acids or salts thereof.

The corresponding homo- or copolymeric polycarboxylic acids or polycarboxylates are described in detail hereinafter. The combination of the two polymers b) and c) in this detergent according to the invention is particularly effective because the polymers b) counteract above all phosphate-containing deposits while the polymers c) prevent the precipitation of calcium carbonate. In the combination, both polymer types show a synergistic effect against bloom on the tableware and the machine parts. The two dosing steps necessary at intervals for the operation of a domestic dishwasher (after a certain number of wash cycles, the regenerating salt in the water softening system of the machine has to be replenished) can be combined into a single step through the detergents according to the invention as described in the foregoing because there is no need for another product (regenerating salt) to be dosed, i.e. for two dosing steps, even after a relatively large number of wash cycles.

This effect of reduced bloom formation and hence the prevention of "lime stains" on tableware can be further enhanced by the addition of nonionic surfactants which provide for improved drainage behavior and, hence, additionally counteract the formation of streaks, particularly on glass surfaces. The detergents according to the invention make the additional dosing of rinse agents unnecessary and, accordingly, represent true "3-in-1" products because they combine the previous products regenerating salt, detergent and rinse agent in a single composition.

In a third embodiment, therefore, the present invention relates to dishwasher detergents which contain a) 1 to 93.8% by weight builder(s), b) 0.1 to 70% by weight copolymers of i) unsaturated carboxylic acids, ii) monomers containing sulfonic acid groups, iii) optionally other ionic or nonionic monomers, c) 0.1 to 30% by weight homo- and/or copolymeric polycarboxylic acids or salts thereof, d) 5 to 30% by weight nonionic surfactant(s).

All the detergents according to the invention mentioned above have the advantage that correspondingly treated tableware becomes distinctly cleaner in subsequent cleaning cycles than tableware cleaned with conventional detergents. The effect is independent of whether the dishwasher detergents are present in liquid form, powder form or tablet form.

An additional positive effect is a reduction in the drying time of the tableware treated with the detergent, i.e. the consumer is able to remove and reuse the tableware earlier after the program has finished.

The invention is distinguished by improved "cleanability" of the treated substrates in subsequent cleaning cycles and by a considerable reduction in drying time in relation to comparable detergents without the polymers containing sulfonic acid groups.

The expression "drying time" in the context of the present invention is generally intended to have the accepted meaning, i.e. the time elapsing before tableware surfaces treated in a dishwasher are dry, but more especially the time elapsing before 90% of a surface treated with a detergent or rinse agent in concentrated or dilute form is dry.

The detergents according to the invention contain one or more builders as ingredient a). These builders are described hereinafter. According to the invention, particularly preferred builders are phosphates and/or citrates.

The dishwasher detergents according to the invention may contain any of the builders typically used in detergents, i.e. in particular zeolites, silicates, carbonates, organic cobuilders and—providing there are no ecological objections to their use—even the phosphates. The builders named hereinafter are all suitable as carrier materials for the rinse agent particles according to the invention, as explained in the foregoing.

Suitable crystalline layered sodium silicates correspond to the general formula $NaMSi_xO_{2x+1}\bullet y\ H_2O$, where M is sodium or hydrogen, x is a number of 1.9 to 4 and y is a number of 0 to 20, preferred values for x being 2, 3 or 4. Preferred crystalline layered silicates corresponding to the above formula are those in which M is sodium and x assumes the value 2 or 3. Both β- and δ-sodium disilicates $Na_2Si_2O_5 \bullet y\ H_2O$ are particularly preferred.

Other useful builders are amorphous sodium silicates with a modulus ($Na_2O:SiO_2$ ratio) of 1:2 to 1:3.3, preferably 1:2 to 1:2.8 and more preferably 1:2 to 1:2.6 which dissolve with delay and exhibit multiple wash cycle properties. The delay in dissolution in relation to conventional amorphous sodium silicates can have been obtained in various ways, for example by surface treatment, compounding/compacting or by overdrying. In the context of the invention, the term "amorphous" is also understood to encompass "X-ray amorphous". In other words, the silicates do not produce any of the sharp X-ray reflexes typical of crystalline substances in X-ray diffraction experiments, but at best one or more maxima of the scattered X-radiation which have a width of several degrees of the diffraction angle. However, particularly good builder properties may even be achieved where the silicate particles produce crooked or even sharp diffraction maxima in electron diffraction experiments. This may be interpreted to mean that the products have microcrystalline regions between 10 and a few hundred nm in size, values of up to at most 50 nm and, more particularly, up to at most 20 nm being preferred. So-called X-ray amorphous silicates such as these, which also dissolve with delay in relation to conventional waterglasses, are described for example in German patent application DE-A-44 00 024. Compacted amorphous silicates, compounded amorphous silicates and overdried X-ray-amorphous silicates are particularly preferred.

The finely crystalline, synthetic zeolite containing bound water used in accordance with the invention is preferably zeolite A and/or zeolite P. Zeolite MAP® (Crosfield) is a particularly preferred P-type zeolite. However, zeolite X and mixtures of A, X and/or P are also suitable. According to the invention, it is preferred to use, for example, a commercially obtainable co-crystallizate of zeolite X and zeolite A (ca. 80% by weight zeolite X) which is marketed by CONDEA Augusta S.p.A. under the name of VEGOBOND AX® and which may be described by the following formula:

$$n Na_2O.(1-n)K_2O.Al_2O_3.(2-2.5)SiO_2.(3.5-5.5)H_2O.$$

Suitable zeolites have a mean particle size of less than 10 μm (volume distribution, as measured by the Coulter Counter Method) and contain preferably 18 to 22% by weight and more preferably 20 to 22% by weight of bound water.

The generally known phosphates may of course also be used as builders providing their use should not be avoided on ecological grounds. Among the large number of commercially available phosphates, alkali metal phosphates have the greatest importance in the detergent industry, pentasodium triphosphate and pentapotassium triphosphate (sodium and potassium tripolyphosphate) being particularly preferred.

"Alkali metal phosphates" is the collective term for the alkali metal (more particularly sodium and potassium) salts of the various phosphoric acids, including metaphosphoric acids $(HPO_3)_n$ and orthophosphoric acid ($H_3PO_4$) and representatives of higher molecular weight. The phosphates combine several advantages: they act as alkalinity sources, prevent lime deposits on machine parts and lime incrustations in fabrics and, in addition, contribute towards the cleaning effect.

Sodium dihydrogen phosphate ($NaH_2PO_4$) exists as the dihydrate (density 1.91 $gcm^{-3}$, melting point 60°) and as the monohydrate (density 2.04 $gcm^{-3}$). Both salts are white readily water-soluble powders which, on heating, lose the water of crystallization and, at 200° C., are converted into the weakly acidic diphosphate (disodium hydrogen diphosphate, $Na_2H_2P_2O_7$) and, at higher temperatures, into sodium trimetaphosphate ($Na_3P_3O_9$) and Maddrell's salt (see below). $NaH_2PO_4$ shows an acidic reaction. It is formed by adjusting phosphoric acid with sodium hydroxide to a pH value of 4.5 and spraying the resulting "mash". Potassium dihydrogen phosphate (primary or monobasic potassium phosphate, potassium biphosphate, KDP), $KH_2PO_4$, is a white salt with a density of 2.33 $gcm^{-3}$, has a melting point of 253° [decomposition with formation of potassium polyphosphate $(KPO_3)_x$] and is readily soluble in water.

Disodium hydrogen phosphate (secondary sodium phosphate), $Na_2HPO_4$, is a colorless, readily water-soluble crystalline salt. It exists in water-free form and with 2 mol (density 2.066 $gcm^{-3}$, water loss at 95°), 7 mol (density 1.68 $gcm^{-3}$, melting point 48° with loss of 5 $H_2O$) and 12 mol of water (density 1.52 $gcm^{-3}$, melting point 35° with loss of 5 $H_2O$), becomes water-free at 100° and, on fairly intensive heating, is converted into the diphosphate $Na_4P_2O_7$. Disodium hydrogen phosphate is prepared by neutralization of phosphoric acid with soda solution using phenolphthalein as indicator. Dipotassium hydrogen phosphate (secondary or dibasic potassium phosphate), $K_2HPO_4$, is an amorphous white salt which is readily soluble in water.

Trisodium phosphate, tertiary sodium phosphate, $Na_3PO_4$, consists of colorless crystals which have a density of 1.62 $gcm^{-3}$ and a melting point of 73–76° C. (decomposition) as the dodecahydrate, a melting point of 100° C. as the decahydrate (corresponding to 19–20% $P_2O_5$) and a density of 2.536 $gcm^{-3}$ in water-free form (corresponding to 39–40% $P_2O_5$). Trisodium phosphate is readily soluble in water through an alkaline reaction and is prepared by concentrating a solution of exactly 1 mole of disodium phosphate and 1 mole of NaOH by evaporation. Tripotassium phosphate (tertiary or tribasic potassium phosphate), $K_3PO_4$, is a white deliquescent granular powder with a density of 2.56 $gcm^{-3}$, has a melting point of 1340° and is readily soluble in water through an alkaline reaction. It is formed, for example, when Thomas slag is heated with coal and potassium sulfate. Despite their higher price, the more readily soluble and therefore highly effective potassium phosphates are often preferred to corresponding sodium compounds in the detergent industry.

Tetrasodium diphosphate (sodium pyrophosphate), $Na_4P_2O_7$, exists in water-free form (density 2.534 $gcm^{-3}$, melting point 988°, a figure of 880° has also been mentioned) and as the decahydrate (density 1.815–1.836 $gcm^{-3}$, melting point 94° with loss of water). Both substances are colorless crystals which dissolve in water through an alkaline reaction. $Na_4P_2O_7$ is formed when disodium phosphate is heated to >200° or by reacting phosphoric acid with soda in a stoichiometric ratio and spray-drying the solution. The decahydrate complexes heavy metal salts and hardness salts and, hence, reduces the hardness of water. Potassium diphosphate (potassium pyrophosphate), $K_4P_2O_7$, exists in the form of the trihydrate and is a colorless hygroscopic powder with a density of 2.33 $gcm^{-3}$ which is soluble in water, the pH value of a 1% solution at 25° being 10.4.

Relatively high molecular weight sodium and potassium phosphates are formed by condensation of $NaH_2PO_4$ or $KH_2PO_4$. They may be divided into cyclic types, namely the sodium and potassium metaphosphates, and chain types, the sodium and potassium polyphosphates. The chain types in particular are known by various different names: fused or calcined phosphates, Graham's salt, Kurrol's salt and Maddrell's salt. All higher sodium and potassium phosphates are known collectively as condensed phosphates.

The industrially important pentasodium triphosphate, $Na_5P_3O_{10}$ (sodium tripolyphosphate), is a non-hygroscopic white water-soluble salt which crystallizes without water or with 6 $H_2O$ and which has the general formula NaO—[P(O)(ONa)—O]$_n$—Na where n=3. Around 17 g of the salt free from water of crystallization dissolve in 100 g of water at room temperature, around 20 g at 60° and around 32 g at 100°. After heating of the solution for 2 hours to 100°, around 8% orthophosphate and 15% diphosphate are formed by hydrolysis. In the preparation of pentasodium triphosphate, phosphoric acid is reacted with soda solution or sodium hydroxide in a stoichiometric ratio and the solution is spray-dried. Similarly to Graham's salt and sodium diphosphate, pentasodium triphosphate dissolves many insoluble metal compounds (including lime soaps, etc.). Pentapotassium triphosphate, $K_5P_3O_{10}$ (potassium tripolyphosphate), is marketed for example in the form of a 50% by weight solution (>23% $P_2O_5$, 25% $K_2O$). The potassium polyphosphates are widely used in the detergent industry. Sodium potassium tripolyphosphates, which may also be used in accordance with the invention, also exist. They are formed for example when sodium trimetaphosphate is hydrolyzed with KOH:

$$(NaPO_3)_3+2\ KOH \rightarrow Na_3K_2P_3O_{10}+H_2O$$

According to the invention, they may be used in exactly the same way as sodium tripolyphosphate, potassium tripolyphosphate or mixtures thereof. Mixtures of sodium tripolyphosphate and sodium potassium tripolyphosphate or mixtures of potassium tripolyphosphate and sodium potassium tripolyphosphate or mixtures of sodium tripolyphosphate and potassium tripolyphosphate and sodium potassium tripolyphosphate may also be used in accordance with the invention.

Organic cobuilders which may be used in the dishwasher detergents according to the invention include, in particular, polycarboxylates/polycarboxylic acids, polymeric polycarboxylates, aspartic acid, polyacetals, dextrins, other organic cobuilders (see below) and phosphonates. These classes of substances are described in the following.

Useful organic builders are, for example, the polycarboxylic acids usable in the form of their sodium salts, polycarboxylic acids in this context being understood to be carboxylic acids which carry more than one acid function. These include, for example, citric acid, adipic acid, succinic acid, glutaric acid, malic acid, tartaric acid, maleic acid, fumaric acid, sugar acids, aminocarboxylic acids, nitrilotriacetic acid (NTA), providing its use is not ecologically unsafe, and mixtures thereof. Preferred salts are the salts of the polycarboxylic acids, such as citric acid, adipic acid, succinic acid, glutaric acid, tartaric acid, sugar acids and mixtures thereof.

The acids per se may also be used. Besides their building effect, the acids also typically have the property of an acidifying component and, hence, also serve to establish a relatively low and mild pH value in detergents or cleaners. Citric acid, succinic acid, glutaric acid, adipic acid, gluconic acid and mixtures thereof are particularly mentioned in this regard.

Other suitable builders are polymeric polycarboxylates, i.e. for example the alkali metal salts of polyacrylic or polymethacrylic acid, for example those with a relative molecular weight of 500 to 70,000 g/mol.

The molecular weights mentioned in this specification for polymeric polycarboxylates are weight-average molecular weights $M_w$ of the particular acid form which, basically, were determined by gel permeation chromatography (GPC) using a UV detector. The measurement was carried out against an external polyacrylic acid standard which provides realistic molecular weight values by virtue of its structural similarity to the polymers investigated. These values differ distinctly from the molecular weights measured against polystyrene sulfonic acids as standard. The molecular weights measured against polystyrene sulfonic acids are generally higher than the molecular weights mentioned in this specification.

Particularly suitable polymers are polyacrylates which preferably have a molecular weight of 2,000 to 20,000 g/mol. By virtue of their superior solubility, preferred representatives of this group are the short-chain polyacrylates which have molecular weights of 2,000 to 10,000 g/mol and, more particularly, 3,000 to 5,000 g/mol.

Also suitable are copolymeric polycarboxylates, particularly those of acrylic acid with methacrylic acid and those of acrylic acid or methacrylic acid with maleic acid. Acrylic acid/maleic acid copolymers containing 50 to 90% by weight of acrylic acid and 50 to 10% by weight of maleic acid have proved to be particularly suitable. Their relative molecular weights, based on the free acids, are generally in the range from 2,000 to 70,000 g/mol, preferably in the range from 20,000 to 50,000 g/mol and more preferably in the range from 30,000 to 40,000 g/mol.

The (co)polymeric polycarboxylates may be used either in powder form or in the form of an aqueous solution. The content of (co)polymeric polycarboxylates in the detergents is preferably 0.5 to 20% by weight and more particularly 3 to 10% by weight.

In order to improve solubility in water, the polymers may also contain allyl sulfonic acids such as, for example, allyloxybenzene sulfonic acid and methallyl sulfonic acid as monomer.

Other particularly preferred polymers are biodegradable polymers of more than two different monomer units, for example those which contain salts of acrylic acid and maleic acid and vinyl alcohol or vinyl alcohol derivatives as monomers or those which contain salts of acrylic acid and 2-alkylallyl sulfonic acid and sugar derivatives as monomers.

Other preferred copolymers are those which preferably contain acrolein and acrylic acid/acrylic acid salts or acrolein and vinyl acetate as monomers.

Other preferred builders are polymeric aminodicarboxylic acids, salts or precursors thereof. Polyaspartic acids or salts and derivatives thereof which have a bleach-stabilizing effect besides their cobuilder properties are particularly preferred.

Other suitable builders are polyacetals which may be obtained by reaction of dialdehydes with polyol carboxylic acids containing 5 to 7 carbon atoms and at least three hydroxyl groups. Preferred polyacetals are obtained from dialdehydes, such as glyoxal, glutaraldehyde, terephthalaldehyde and mixtures thereof and from polyol carboxylic acids, such as gluconic acid and/or glucoheptonic acid.

Other suitable organic builders are dextrins, for example oligomers or polymers of carbohydrates which may be obtained by partial hydrolysis of starches. The hydrolysis may be carried out by standard methods, for example acid- or enzyme-catalyzed methods. The end products are preferably hydrolysis products with average molecular weights of 400 to 500,000 g/mol. A polysaccharide with a dextrose equivalent (DE) of 0.5 to 40 and, more particularly, 2 to 30 is preferred, the DE being an accepted measure of the reducing effect of a polysaccharide by comparison with dextrose which has a DE of 100. Both maltodextrins with a DE of 3 to 20 and dry glucose sirups with a DE of 20 to 37 and also so-called yellow dextrins and white dextrins with relatively high molecular weights of 2,000 to 30,000 g/mol may be used.

The oxidized derivatives of such dextrins are their reaction products with oxidizing agents which are capable of oxidizing at least one alcohol function of the saccharide ring to the carboxylic acid function. An oxidized oligosaccharide is also suitable. A product oxidized at $C_6$ of the saccharide ring can be particularly advantageous.

Other suitable co-builders are oxydisuccinates and other derivatives of disuccinates, preferably ethylenediamine disuccinate. Ethylenediamine-N,N'-disuccinate (EDDS) is preferably used in the form of its sodium or magnesium salts. Glycerol disuccinates and glycerol trisuccinates are also preferred in this connection. The quantities used in zeolite-containing and/or silicate-containing formulations are from 3 to 15% by weight.

Other useful organic co-builders are, for example, acetylated hydroxycarboxylic acids and salts thereof which may optionally be present in lactone form and which contain at least 4 carbon atoms, at least one hydroxy group and at most two acid groups.

Another class of substances with co-builder properties are the phosphonates, more particularly hydroxyalkane and aminoalkane phosphonates. Among the hydroxyalkane phosphonates, 1-hydroxyethane-1,1-diphosphonate (HEDP) is particularly important as a co-builder. It is preferably used in the form of the sodium salt, the disodium salt showing a neutral reaction and the tetrasodium salt an alkaline reaction (pH 9). Preferred aminoalkane phosphonates are ethylenediamine tetramethylene phosphonate (EDTMP), diethylenetriamine pentamethylenephosphonate (DTPMP) and higher homologs thereof. They are preferably used in the form of the neutrally reacting sodium salts, for example as the hexasodium salt of EDTMP or as the hepta- and octasodium salts of DTPMP. Of the phosphonates, HEDP is preferably used as a builder. In addition, the aminoalkane phosphonates have a pronounced heavy metal binding capacity. Accordingly, it can be of advantage, particularly where the foams also contain bleach, to use aminoalkane phosphonates, more particularly DTPMP, or mixtures of the phosphonates mentioned.

In addition, any compounds capable of forming complexes with alkaline earth metal ions may be used as co-builders.

The polymers containing sulfonic acid groups suitable for use as ingredient b) in accordance with the invention are described in detail hereinafter.

According to the invention, preferred monomers are unsaturated carboxylic acids corresponding to formula (I):

$$R^1(R^2)C{=}C(R^3)COOH \quad (I)$$

in which $R^1$ to $R^3$ independently of one another represent —H, —$CH_3$, a linear or branched, saturated alkyl group containing 2 to 12 carbon atoms, a linear or branched, mono- or polyunsaturated alkenyl group containing 2 to 12 carbon atoms, —$NH_2$—, —OH— or —COOH-substituted alkyl or alkenyl groups as defined above or —COOH or —$COOR^4$, where $R^4$ is a saturated or unsaturated, linear or branched hydrocarbon radical containing 1 to 12 carbon atoms.

Among the unsaturated carboxylic acids corresponding to formula (I), acrylic acid ($R^1{=}R^2{=}R^3{=}H$), methacrylic acid ($R^1{=}R^2{=}H; R^3{=}CH_3$) and/or maleic acid ($R^1{=}COOH; R^2{=}R^3{=}H$) are particularly preferred.

Preferred monomers containing sulfonic acid groups correspond to formula (II):

$$R^5(R^6)C{=}C(R^7)—X—SO_3H \quad (II)$$

in which $R^5$ to $R^7$ independently of one another represent —H, —$CH_3$, a linear or branched, saturated alkyl group containing 2 to 12 carbon atoms, a linear or branched, mono- or polyunsaturated alkenyl group containing 2 to 12 carbon atoms, —$NH_2$—, —OH— or —COOH-substituted alkyl or alkenyl groups as defined above or —COOH or —$COOR^4$, where $R^4$ is a saturated or unsaturated, linear or branched hydrocarbon radical containing 1 to 12 carbon atoms, and X is an optionally present spacer group selected from —$(CH_2)_n$— with n=0 to 4, —COO—$(CH_2)_k$— with k=1 to 6, —C(O)—NH—$C(CH_3)_2$— and —C(O)—NH—CH$(CH_2CH_3)$—.

Among these monomers, those corresponding to formulae (IIa), (IIb) and/or (IIc):

$$H_2C{=}CH—X—SO_3H \quad (IIa)$$

$$H_2C{=}C(CH_3)—X—SO_3H \quad (IIb)$$

$$HO_3S—X—(R^6)C{=}C(R^7)—X—SO_3H \quad (IIc)$$

in which $R^6$ and $R^7$ independently of one another are selected from —H, —$CH_3$, —$CH_2CH_3$, —$CH_2CH_2CH_3$, —$CH(CH_3)_2$ and X is an optionally present spacer group selected from —$(CH_2)_n$— with n=0 to 4, —COO—$(CH_2)_k$— with k=1 to 6, —C(O)—NH—$C(CH_3)_2$— and —C(O)—NH—$CH(CH_2CH_3)$—, are preferred Particularly preferred monomers containing sulfonic acid groups are 1-acrylamido-1-propanesulfonic acid (X=—C(O)NH—$CH(CH_2CH_3)$ in formula (IIa)), 2-acrylamido-2-propanesulfonic acid (X=—C(O)NH—$C(CH_3)_2$ in formula (IIa)), 2-acrylamido-2-methyl-1-propanesulfonic acid (X=—C(O)NH—$CH(CH_3)CH_2$— in formula IIa)), 2-methacrylamido-2-methyl-1-propanesulfonic acid (X=—C(O)NH—$H(CH_3)CH_2$— in formula (IIb)), 3-methacrylamido-2-hydroxypropanesulfonic acid (X=—C(O)NH—$CH_2OH(OH)CH_2$— in formula (IIb)), allyl sulfonic acid (X=$CH_2$ in formula (IIa)), methallylsulfonic acid (X=$CH_2$ in formula (IIb)), allyloxybenzenesulfonic acid (X=—$CH_2$—O—$C_6H_4$— in formula (IIa)), methallyloxybenzenesulfonic acid (X=—$CH_2$—O—$C_6H_4$— in formula (IIb)), 2-hydroxy-3-(2-propenyloxy)-propanesulfonic acid, 2-methyl-2-propene-1-sulfonic acid (X=$CH_2$ in formula (IIb)), styrenesulfonic acid (X=$C_6H_4$ in formula (IIa)), vinylsulfonic acid (X not present in formula (IIa)), 3-sulfopropylacrylate (X=—C(O)NH—$CH_2CH_2CH_2$— in formula (IIa)), 3-sulfopropylmethacrylate (X=—C(O)NH—$CH_2CH_2CH_2$— in formula (IIb)), sulfomethacrylamide (X=—C(O)NH— in formula (IIb)), sulfomethylmethacrylamide (X=—C(O)NH—$CH_2$— in formula (IIb)) and water-soluble salts of the acids mentioned.

Suitable other ionic or nonionic monomers are, in particular, ethylenically unsaturated compounds. The polymers used in accordance with the invention preferably contain less than 20% by weight, based on polymer, of monomers belonging to group iii). Particularly preferred polymers consist solely of monomers belonging to groups i) and ii).

To sum up, particular preference is attributed to the use of one or more copolymers of i) unsaturated carboxylic acids corresponding to formula (I):

$$R^1(R^2)C{=}C(R^3)COOH \quad (I)$$

in which $R^1$ to $R^3$ independently of one another represent —H, —$CH_3$, a linear or branched, saturated alkyl group containing 2 to 12 carbon atoms, a linear or branched, mono- or polyunsaturated alkenyl group containing 2 to 12 carbon atoms, —$NH_2$—, —OH— or —COOH-substituted alkyl or alkenyl groups as defined above or —COOH or —$COOR^4$, where $R^4$ is a saturated or unsaturated, linear or branched hydrocarbon radical containing 1 to 12 carbon atoms, ii) monomers containing sulfonic acid groups corresponding to formula (II):

$$R^5(R^6)C{=}C(R^7)—X—SO_3H \quad (II)$$

in which $R^5$ to $R^7$ independently of one another represent —H, —$CH_3$, a linear or branched, saturated alkyl group containing 2 to 12 carbon atoms, a linear or branched, mono- or polyunsaturated alkenyl group containing 2 to 12 carbon atoms, —$NH_2$—, —OH— or —COOH-substituted alkyl or alkenyl groups as defined above or —COOH or —$COOR^4$, where $R^4$ is a saturated or unsaturated, linear or branched hydrocarbon radical containing 1 to 12 carbon atoms, and X is an optionally present spacer group selected from —$(CH_2)_n$— with n=0 to 4, —COO—$(CH_2)_k$— with k=1 to 6, —C(O)—NH—$C(CH_3)_2$— and —C(O)—NH—CH$(CH_2CH_3)$—, iii) optionally other ionic or nonionic monomers.

A particularly preferred use is characterized in that one or more copolymers of i) one or more unsaturated carboxylic acids from the group consisting of acrylic acid, methacrylic acid and/or maleic acid, ii) one or more monomers containing sulfonic acid groups corresponding to formulae (IIa), (IIb) and/or (IIc):

$$H_2C{=}CH—X—SO_3H \quad (IIa)$$

$$H_2C{=}C(CH_3)—X—SO_3H \quad (IIb)$$

$$HO_3S—X—(R^6)C{=}C(R^7)—X—SO_3H \quad (IIc)$$

in which $R^6$ and $R^7$ independently of one another are selected from —H, —$CH_3$, —$CH_2CH_3$, —$CH_2CH_2CH_3$, —$CH(CH_3)_2$ and X is an optionally present spacer group selected from —$(CH_2)_k$— with n=0 to 4, —COO—$(CH_2)_k$— with k=1 to 6, —C(O)—NH—$C(CH_3)_2$— and —C(O)—NH—$CH(CH_2CH_3)$—, iii) optionally other ionic or nonionic monomers, is/are used.

The copolymers used in accordance with the invention may contain the monomers belonging to groups i) and ii) and optionally iii) in varying quantities, all representatives of group i) being combinable with all representatives of group ii) and all representatives of group iii). Particularly preferred polymers contain certain structural units which are described in the following.

For example, a preferred use according to the invention is characterized in that one or more copolymers containing structural units corresponding to formula (III):

$$—[CH_2—CHCOOH]_m—[CH_2—CHC(O)—Y—SO_3H]_p— \quad (III)$$

in which m and p are whole natural numbers of 1 to 2,000 and Y is a spacer group selected from substituted or unsubstituted aliphatic, aromatic or araliphatic hydrocarbon radicals containing 1 to 24 carbon atoms, spacer groups in which Y represents $—O—(CH_2)_n—$ with n=0 to 4, $—O—(C_6H_4)—$, $—NH—C(CH_3)_2—$ or $—NH—CH(CH_2CH_3)—$ being preferred,
is/are used These polymers are produced by copolymerization of acrylic acid with an acrylic acid derivative containing sulfonic acid groups. If the acrylic acid derivative containing sulfonic acid groups is copolymerized with methacrylic acid, another polymer is obtained which is also preferably used and which is characterized in that one or more copolymers are used which contain structural units corresponding to formula (IV):

$$—[CH_2—CHCOOH]_m—[CH_2—CHC(O)—Y—SO_3H]_p— \quad (IV)$$

in which m and p are whole natural numbers of 1 to 2,000 and Y is a spacer group selected from substituted or unsubstituted aliphatic, aromatic or araliphatic hydrocarbon radicals containing 1 to 24 carbon atoms, spacer groups in which Y represents $—O—(CH_2)_n—$ with n=0 to 4, $—O—(C_6H_4)—$, $—NH—C(CH_3)_2—$ or $—NH—CH(CH_2CH_3)—$ being preferred in which m and p are whole natural numbers of 1 to 2,000 and Y is a spacer group selected from substituted or unsubstituted aliphatic, aromatic or araliphatic hydrocarbon radicals containing 1 to 24 carbon atoms, spacer groups in which Y represents $—O—(CH_2)_n—$ with n=0 to 4, $—O—(C_6H_4)—$, $—NH—C(CH_3)_2—$ or $—NH—CH(CH_2CH_3)—$ being preferred.

Entirely analogously, acrylic acid and/or methacrylic acid may also be copolymerized with methacrylic acid derivatives containing sulfonic acid groups, so that the structural units in the molecule are changed. Thus, the use in accordance with the invention of one or more copolymers containing structural units corresponding to formula (V):

$$—[CH_2—CHCOOH]_m—[CH_2—C(CH_3)C(O)—Y—SO_3H]_p— \quad (V)$$

in which m and p are whole natural numbers of 1 to 2,000 and Y is a spacer group selected from substituted or unsubstituted aliphatic, aromatic or araliphatic hydrocarbon radicals containing 1 to 24 carbon atoms, spacer groups in which Y represents $—O—(CH_2)_n—$ with n=0 to 4, $—O—(C_6H_4)—$, $—NH—C(CH_3)_2—$ or $—NH—CH(CH_2CH_3)—$ being preferred, represents another preferred embodiment of the invention, as do uses which are characterized in that one or more copolymers containing structural units corresponding to formula (VI):

$$—[CH_2—C(CH_3)COOH]_m—[CH_2—C(CH_3)C(O)—Y—SO_3H]_p— \quad (VI)$$

in which m and p are whole natural numbers of 1 to 2,000 and Y is a spacer group selected from substituted or unsubstituted aliphatic, aromatic or araliphatic hydrocarbon radicals containing 1 to 24 carbon atoms, spacer groups in which Y represents $—O—(CH_2)_n—$ with n=0 to 4, $—O—(C_6H_4)—$, $—NH—C(CH_3)_2—$ or $—NH—CH(CH_2CH_3)—$ being preferred,
is/are used.

Maleic acid may also be used as a particularly preferred group i) monomer instead of or in addition to acrylic acid and/or methacrylic acid. In this way, it is possible to arrive at preferred uses according to the invention which are characterized in that one or more copolymers is/are used which contain structural units corresponding to formula (VII):

$$—[HOOCCH—CHCOOH]_m—[CH_2—CHC(O)—Y—SO_3H]_p— \quad (VII)$$

in which m and p are whole natural numbers of 1 to 2,000 and Y is a spacer group selected from substituted or unsubstituted aliphatic, aromatic or araliphatic hydrocarbon radicals containing 1 to 24 carbon atoms, spacer groups in which Y represents $—O—(CH_2)_n—$ with n=0 to 4, $—O—(C_6H_4)—$, $—NH—C(CH_3)_2—$ or $—NH—CH(CH_2CH_3)—$ being preferred, and uses which are characterized in that one or more copolymers is/are used which contain structural units corresponding to formula (VIII):

$$—[HOOCCH—CHCOOH]_m—[CH_2—C(CH_3)C(O)O—Y—SO_3H]_p— \quad (VIII)$$

in which m and p are whole natural numbers of 1 to 2,000 and Y is a spacer group selected from substituted or unsubstituted aliphatic, aromatic or araliphatic hydrocarbon radicals containing 1 to 24 carbon atoms, spacer groups in which Y represents $—O—(CH_2)_n—$ with n=0 to 4, $—O—(C_6H_4)—$, $—NH—C(CH_3)_2—$ or $—NH—CH(CH_2CH_3)—$ being preferred.

The sulfonic acid groups may be present in the polymers completely or partly in neutralized form, i.e. the acidic hydrogen atom of the sulfonic acid groups being replaceable by metal ions, preferably alkali metal ions and more particularly sodium ions, in some or all of the sulfonic acid groups. Corresponding uses which are characterized in that the sulfonic acid groups in the copolymer are present in partly or fully neutralized form represent a preferred embodiment of the invention.

In the case of copolymers which only contain group i) and group ii) monomers, the monomer distribution in the copolymers used in accordance with the invention is preferably 5 to 95% by weight i) or ii) and more preferably 50 to 90% by weight group i) monomer and 10 to 50% by weight group ii) monomer, based in each case on the polymer.

Particularly preferred terpolymers contain 20 to 85% by weight group i) monomer, 10 to 60% by weight group ii) monomer and 5 to 30% by weight group iii) monomer.

The molecular weight of the polymers used in accordance with the invention may be varied in order to adapt the properties of the polymers to the particular application envisaged. Preferred uses are characterized in that the copolymers have molecular weights of 2,000 to 200,000 $gmol^{-1}$, preferably in the range from 4,000 to 25,000 $gmol^{-1}$ and more particularly in the range from 5,000 to 15,000 $gmol^{-1}$.

To sum up, particularly preferred dishwasher detergents are those which contain as ingredient b) one or more copolymers containing structural units corresponding to formulae (III) and/or (IV) and/or (V) and/or (VI) and/or (VII) and/or (VIII)

$$—[CH_2—CHCOOH]_m—[CH_2—CHC(O)—Y—SO_3H]_p— \quad (III)$$

$$—[CH_2—CHCOOH]_m—[CH_2—CHC(O)—Y—SO_3H]_p— \quad (IV)$$

$$—[CH_2—C(CH_3)COOH]_m—[CH_2—C(CH_3)C(O)—Y—SO_3H]_p— \quad (VI)$$

$$—[HOOCCH—CHCOOH]_m—[CH_2—CHC(O)—Y—SO_3H]_p— \quad (VII)$$

$$—[HOOCCH—CHCOOH]_m—[CH_2—C(CH_3)C(O)O—Y—SO_3H]_p— \quad (VIII)$$

in which m and p are whole natural numbers of 1 to 2,000 and Y is a spacer group selected from substituted or unsubstituted aliphatic, aromatic or araliphatic hydrocarbon radicals containing 1 to 24 carbon atoms, spacer groups in which Y represents $—O—(CH_2)_n—$ with n=0 to 4, $—O—(C_6H_4)—$, $—NH—C(CH_3)_2—$ or $—NH—CH(CH_2CH_3)—$ being preferred.

The quantities in which the copolymers b) are present in the detergents according to the invention may vary according to the desired product (recommended dosage). In general, preferred dishwasher detergents according to the invention are characterized in that the sulfonated copolymer(s) are present in quantities of 0.25 to 50% by weight, preferably 0.5 to 35% by weight, more preferably 0.75 to 20% by weight and most preferably 1 to 15% by weight.

Besides the sulfonated copolymers b), the detergents according to the invention may contain polycarboxylic acids or salts thereof. According to the invention, particularly suitable homopolymers or copolymers c) are polyacrylates, polymethacrylates, copolymers of acrylic and/or methacrylic acid with maleic acid and copolymers of maleic acid with olefins. Accordingly, preferred dishwasher detergents according to the invention are characterized in that they contain homo- and/or copolymers of acrylic acid and/or methacrylic acid and/or maleic acid as homo- and/or copolymeric polycarboxylic acids or salts thereof.

If the dishwasher detergents according to the invention contain (co)polymeric polycarboxylates, the polycarboxylates described above in connection with the cobuilders are particularly preferred.

To sum up, preferred dishwasher detergents according to the invention are characterized in that they additionally contain copolymeric polycarboxylates, particularly those of acrylic acid with methacrylic acid and/or acrylic acid or methacrylic acid with maleic acid as ingredient c), copolymers of acrylic acid with maleic acid which contain 50 to 90% by weight acrylic acid and 50 to 10% by weight maleic acid being preferred and polymers with relative molecular weights, based on free acids, of 2,000 to 70,000 g/mol, preferably 20,000 to 50,000 g/mol and more particularly 30,000 to 40,000 g/mol being particularly preferred.

In particularly preferred dishwasher detergents, the ratio by weight of sulfonated copolymers b) to (meth)acrylate copolymers c) is 100:1 to 1:100, preferably 25:1 to 1:50, more preferably 10:1 to 1:25 and most preferably 5:1 to 1:10.

In addition to the ingredients a) to c) or a) to d), the detergents according to the invention may contain other ingredients. Important ingredients from the groups of bleaching agents, bleach activators, enzymes, silver protectors, cobuilders, dyes and perfumes, etc. are described in detail hereinafter. In a particularly preferred embodiment of the invention, the dishwasher detergents additionally contain one or more substances from the group of acidifying agents, chelating agents or bloom-inhibiting polymers.

Substances from the group of acidifying agents are, for example, boric acid and alkali metal hydrogen sulfates, alkali metal dihydrogen phosphates and other inorganic salts. However, organic acidifying agents are preferably used, citric acid being a particularly preferred acidifying agent. However, other solid mono-, oligo- and polycarboxylic acids in particular may also be used. Within this group, tartaric acid, succinic acid, malonic acid, adipic acid, maleic acid, fumaric acid, oxalic acid and polyacrylic acid are preferred. Organic sulfonic acids, such as amidosulfonic acid, may also be used. Sokalan® DCS (trademark of BASF), a mixture of succinic acid (max. 31% by weight), glutaric acid (max. 50% by weight) and adipic acid (max. 33% by weight), is commercially obtainable and may also be used with advantage as an acidifying agent for the purposes of the present invention.

Another possible group of ingredients are chelating agents. Chelating agents are substances which form cyclic compounds with metal ions, an individual ligand occupying more than one co-ordination site at a central atom, i.e. is at least "bidentate", In this case, therefore, normally stretched compounds are closed to form rings by complexing via an ion. The number of bound ligands depends upon the co-ordination number of the central ion.

Typical and—according to the invention—preferred chelating agents are, for example, polyoxycarboxylic acids, polyamines, ethylenediamine tetraacetic acid (EDTA) and nitrilotriacetic acid (NTA). Complexing polymers, i.e. polymers which, either in the main chain itself or laterally thereof, carry functional groups which are capable of acting as ligands and which react with suitable metal atoms, generally to form chelate complexes, may also be used in accordance with the invention. The polymer-bound ligands of the metal complexes formed may emanate from only one macromolecule or belong to various polymer chains. The latter leads to crosslinking of the material providing the complexing polymers were not already crosslinked through covalent bonds.

Complexing groups (ligands) of typical complexing polymers are iminodiacetic acid, hydroxyquinoline, thiourea, guanidine, dithiocarbamate, hydroxamic acid, amidoxime, aminophosphonic acid, (cycl.) polyamino, mercapto, 1,3-dicarbonyl and crown ether residues with, in some cases, very specific activities towards ions of various metals. Base polymers of many—even commercially significant—complexing polymers are polystyrene, polyacrylates, polyacrylonitriles, polyvinyl alcohols, polyvinyl pyridines and polyethylene imines. Natural polymers, such as cellulose, starch or chitin, are complexing polymers. In addition, these complexing polymers can be provided with further ligand functionalities by polymer-analog conversions.

According to the invention, particularly preferred dishwasher detergents contain one or more chelating agents from the groups of (i) polycarboxylic acids where the sum of carboxyl and optionally hydroxyl groups is at least 5,
(ii) nitrogen-containing mono- or polycarboxylic acids,
(iii) geminal diphosphonic acids,
(iv) aminophosphonic acids,
(v) phosphonopolycarboxylic acids,
(vi) cyclodextrins, in quantities above 0.1% by weight, preferably above 0.5% by weight, more preferably above 1% by weight and most preferably above 2.5% by weight, based on the weight of the dishwasher detergent.

Any known complexing agents may be used for the purposes of the present invention. They may belong to various chemical groups. The following are preferably used either individually or in the form of mixtures with one another:

a) polycarboxylic acids where the sum of carboxyl and optionally hydroxyl groups is at least 5, such as gluconic acid, b) nitrogen-containing mono- or polycarboxylic acids, such as ethylenediamine tetraacetic acid (EDTA), N-hydroxyethyl ethylenediamine triacetic acid, diethylenetriamine pentaacetic acid, hydroxyethyl iminodiacetic acid, nitrilodiacetic acid-3-propionic acid, isoserine diacetic acid, N,N-di-(β-hydroxyethyl)-glycine, N-(1,2-dicarboxy-2-hydroxyethyl)-glycine, N-(1,2-dicarboxy-2-hydroxyethyl)-aspartic acid or nitrilotriacetic acid (NTA), c) geminal diphosphonic acids, such as 1-hydroxyethane-1,1-diphosphonic acid (HEDP), higher homologs thereof containing up to 8 carbon atoms and hydroxyfunctional or aminofunctional derivatives thereof and 1-aminoethane-1,1-diphosphonic acid, higher homologs thereof containing up to 8 carbon atoms and hydroxyfunctional or aminofunctional derivatives thereof, d) aminophosphonic acids, such as ethylenediamine tetra (methylenephosphonic acid), diethylenetriamine penta (methylenephosphonic acid) or nitrilotri (methylenephosphonic acid), e) phosphonopolycarboxylic acids, such as 2-phosphonobutane-1,2,4-tricarboxylic acid, and f) cyclodextrins.

In the context of the present invention, polycarboxylic acids a) are also understood to encompass carboxylic acids and monocarboxylic acids where the sum of carboxyl groups and the hydroxyl groups present in the molecule is at least 5. Complexing agents from the group of nitrogen-containing polycarboxylic acids, more especially EDTA, are preferred. These complexing agents are at least partly present as anions at the alkaline pH values of the treatment solutions required in accordance with the invention. It does not matter whether they are introduced in the form of the acids or in the form of salts. Where they are used in the form of salts, alkali metal, ammonium or alkylammonium salts, especially sodium salts, are preferred.

The nonionic surfactants which may be used in the dishwasher detergents according to the present invention are described in detail hereinafter. According to the invention, the quantities in which the nonionic surfactants are used are between 5 and 30% by weight, preferred dishwasher detergents containing 5 to 25% by weight, preferably 6 to 22.5% by weight, more preferably 7.5 to 20% by weight and most preferably 8 to 17.5% by weight of nonionic surfactant(s).

Preferred nonionic surfactants are alkoxylated, advantageously ethoxylated, more especially primary alcohols preferably containing 8 to 18 carbon atoms and, on average, 1 to 12 mol ethylene oxide (EO) per mol alcohol, in which the alcohol group may be linear or, preferably, methyl-branched in the 2-position or may contain linear and methyl-branched groups in the form of the mixtures typically present in oxoalcohol groups. However, alcohol ethoxylates containing linear groups of alcohols of native origin with 12 to 18 carbon atoms, for example coconut, palm, tallow or oleyl alcohol, and on average 2 to 8 EO per mole of alcohol are particularly preferred. Preferred ethoxylated alcohols include, for example, $C_{12-14}$ alcohols containing 3 EO or 4 EO, $C_{9-11}$ alcohol containing 7 EO, $C_{13-15}$ alcohols containing 3 EO, 5 EO, 7 EO or 8 EO, $C_{12-18}$ alcohols containing 3 EO, 5 EO or 7 EO and mixtures thereof, such as mixtures of $C_{12-14}$ alcohol containing 3 EO and $C_{12-18}$ alcohol containing 5 EO. The degrees of ethoxylation mentioned represent statistical mean values which, for a special product, can be a whole number or a broken number. Preferred alcohol ethoxylates have a narrow homolog distribution (narrow range ethoxylates, NRE). In addition to these nonionic surfactants, fatty alcohols containing more than 12 EO may also be used, examples including tallow fatty alcohol containing 14 EO, 25 EO, 30 EO or 40 EO.

Suitable other nonionic surfactants are alkyl glycosides with the general formula $RO(G)_x$ where R is a primary, linear or methyl-branched, more particularly 2-methyl-branched, aliphatic radical containing 8 to 22 and preferably 12 to 18 carbon atoms and G stands for a glycose unit containing 5 or 6 carbon atoms, preferably glucose. The degree of oligomerization x, which indicates the distribution of monoglycosides and oligoglycosides, is a number of 1 to 10 and preferably 1.2 to 1.4.

Another class of preferred nonionic surfactants which may be used either as sole nonionic surfactant or in combination with other nonionic surfactants are alkoxylated, preferably ethoxylated or ethoxylated and propoxylated, fatty acid alkyl esters preferably containing 1 to 4 carbon atoms in the alkyl chain.

Nonionic surfactants of the amine oxide type, for example N-coconutalkyl-N,N-dimethylamine oxide and N-tallowalkyl-N,N-dihydroxy-ethylamine oxide, and the fatty acid alkanolamide type are also suitable. The quantity in which these nonionic surfactants are used is preferably no more than the quantity in which the ethoxylated fatty alcohols are used and, more preferably, no more than half that quantity.

Other suitable surfactants are polyhydroxyfatty acid amides corresponding to formula (IX):

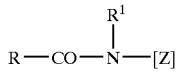

(IX)

in which RCO is an aliphatic acyl group containing 6 to 22 carbon atoms, $R^1$ is hydrogen, an alkyl or hydroxyalkyl group containing 1 to 4 carbon atoms and [Z] is a linear or branched polyhydroxyalkyl group containing 3 to 10 carbon atoms and 3 to 10 hydroxyl groups. The polyhydroxyfatty acid amides are known substances which may normally be obtained by reductive amination of a reducing sugar with ammonia, an alkylamine or an alkanolamine and subsequent acylation with a fatty acid, a fatty acid alkyl ester or a fatty acid chloride.

The group of polyhydroxyfatty acid amides also includes compounds corresponding to formula (X):

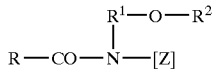

(X)

in which R is a linear or branched alkyl or alkenyl group containing 7 to 12 carbon atoms, $R^1$ is a linear, branched or cyclic alkyl group or an aryl group containing 2 to 8 carbon atoms and $R^2$ is a linear, branched or cyclic alkyl group or an aryl group or an oxyalkyl group containing 1 to 8 carbon atoms, $C_{1-4}$ alkyl or phenyl groups being preferred, and [Z] is a linear polyhydroxyalkyl group, of which the alkyl chain is substituted by at least two hydroxyl groups, or alkoxylated, preferably ethoxylated or propoxylated, derivatives of that group.

[Z] is preferably obtained by reductive amination of a reduced sugar, for example glucose, fructose, maltose, lactose, galactose, mannose or xylose. The N-alkoxy- or N-aryloxy-substituted compounds may then be converted into the required polyhydroxyfatty acid amides by reaction with fatty acid methyl esters in the presence of an alkoxide as catalyst.

Preferred surfactants are low-foaming nonionic surfactants. In a particularly preferred embodiment, the dishwasher detergents according to the invention contain nonionic surfactants, more especially nonionic surfactants from the group of alkoxylated alcohols. Preferred nonionic surfactants are alkoxylated, advantageously ethoxylated, more especially primary alcohols preferably containing 8 to 18 carbon atoms and, on average, 1 to 12 mol ethylene oxide (EO) per mol alcohol, in which the alcohol group may be linear or, preferably, methyl-branched in the 2-position or may contain linear and methyl-branched groups in the form of the mixtures typically present in oxoalcohol groups. However, alcohol ethoxylates containing linear groups of alcohols of native origin with 12 to 18 carbon atoms, for example coconut, palm, tallow or oleyl alcohol, and on average 2 to 8 EO per mole of alcohol are particularly preferred. Preferred ethoxylated alcohols include, for example, $C_{12-14}$ alcohols containing 3 EO or 4 EO, $C_{9-11}$ alcohol containing 7 EO, $C_{13-15}$ alcohols containing 3 EO, 5 EO, 7 EO or 8 EO, $C_{12-18}$ alcohols containing 3 EO, 5 EO or 7 EO and mixtures thereof, such as mixtures of $C_{12-14}$ alcohol containing 3 EO and $C_{12-18}$ alcohol containing 5 EO. The degrees of ethoxylation mentioned represent statistical mean values which, for a special product, can be a whole number or a broken number. Preferred alcohol ethoxylates have a narrow homolog distribution (narrow range ethoxylates, NRE). In addition to these nonionic surfactants, fatty alcohols containing more than 12 EO may also be used, examples including tallow fatty alcohol containing 14 EO, 25 EO, 30 EO or 40 EO.

Detergents according to the invention which contain a nonionic surfactant having a melting point above room temperature are particularly preferred. Accordingly, preferred detergents are characterized in that they contain (a) nonionic surfactant(s) with a melting point above 20° C., preferably above 25° C., more preferably between 25 and 60° C. and, more particularly, between 26.6 and 43.3° C.

Suitable nonionic surfactants with melting or softening points in the temperature range mentioned above are, for example, low-foaming nonionic surfactants which may be solid or highly viscous at room temperature. If nonionic surfactants highly viscous at room temperature are used, they preferably have a viscosity above 20 Pas, more preferably above 35 Pas and most preferably above 40 Pas. Nonionic surfactants which are wax-like in consistency at room temperature are also preferred. Nonionic surfactants solid at room temperature preferably used in accordance with the invention belong the groups of alkoxylated nonionic surfactants, more particularly ethoxylated primary alcohols, and mixtures of these surfactants with structurally complex surfactants, such as polyoxypropylene/polyoxyethylene/polyoxypropylene (PO/EO/PO) surfactants. In addition, (PO/EO/PO) nonionic surfactants are distinguished by good foam control.

In one preferred embodiment of the present invention, the nonionic surfactant with a melting point above room temperature is an ethoxylated nonionic surfactant emanating from the reaction of a monohydroxyalkanol or alkylphenol containing 6 to 20 carbon atoms with preferably at least 12 mol, more preferably at least 15 mol and most preferably at least 20 mol of ethylene oxide per mol of alcohol or alkylphenol.

A particularly preferred nonionic surfactant solid at room temperature is obtained from a straight-chain fatty alcohol containing 16 to 20 carbon atoms ($C_{16-20}$ alcohol), preferably a $C_{18}$ alcohol, and at least 12 mol, preferably at least 15 mol and more preferably at least 20 mol of ethylene oxide. Of these nonionic surfactants, the so-called narrow range ethoxylates (see above) are particularly preferred.

Accordingly, particularly preferred rinse agents according to the invention contain ethoxylated nonionic surfactant(s) obtained from $C_{6-20}$ monohydroxyalkanols or $C_{6-20}$ alkylphenols or $C_{16-20}$ fatty alcohols and more than 12 mol, preferably more than 15 mol and more particularly more than 20 mol ethylene oxide per mol alcohol.

The nonionic surfactant solid at room temperature preferably also contains propylene oxide units in the molecule. These PO units preferably make up as much as 25% by weight, more preferably as much as 20% by weight and, most preferably, up to 15% by weight of the total molecular weight of the nonionic surfactant. Particularly preferred nonionic surfactants are ethoxylated monohydroxyalkanols or alkylphenols which additionally contain polyoxyethylene/polyoxypropylene block copolymer units. The alcohol or alkylphenol component of these nonionic surfactant molecules preferably makes up more than 30% by weight, more preferably more than 50% by weight and most preferably more than 70% by weight of the total molecular weight of these nonionic surfactants. Preferred rinse agents are characterized in that they contain ethoxylated and propoxylated nonionic surfactants where the propylene oxide units in the molecule make up as much as 25% by weight, preferably 20% by weight and more particularly 15% by weight of the total molecular weight of the nonionic surfactant.

Other particularly preferred nonionic surfactants with melting points above room temperature contain 40 to 70% of a polyoxypropylene/polyoxyethylene/polyoxpropylene block polymer blend which contains 75% by weight of an inverted block copolymer of polyoxyethylene and polyoxypropylene with 17 moles of ethylene oxide and 44 moles of propylene oxide and 25% by weight of a block copolymer of polyoxyethylene and polyoxypropylene initiated with trimethylol propane and containing 24 moles of ethylene oxide and 99 moles of propylene oxide per mole of trimethylol propane.

Nonionic surfactants which may be used with particular advantage are obtainable, for example, under the name of Poly Tergent® SLF-18 from Olin Chemicals.

Another preferred rinse agent according to the invention contains nonionic surfactants corresponding to the following formula:

$$R^1O[CH_2CH(CH_3)O]_x[CH_2CH_2O]_y[CH_2CH(OH)R^2]$$

in which $R^1$ is a linear or branched aliphatic hydrocarbon radical containing 4 to 18 carbon atoms or mixtures thereof, $R^2$ is a linear or branched hydrocarbon radical containing 2 to 26 carbon atoms or mixtures thereof, x has a value of 0.5 to 1.5 and y has a value of at least 15.

Other preferred nonionic surfactants are the end-capped poly(oxyalkylated) nonionic surfactants corresponding to the following formula:

$$R^1O[CH_2CH(R^3)O]_x[CH_2]_kCH(OH)[CH_2]_jOR^2$$

in which $R^1$ and $R^2$ are linear or branched, saturated or unsaturated, aliphatic or aromatic hydrocarbon radicals containing 1 to 30 carbon atoms, $R^3$ stands for H or for a methyl, ethyl, n-propyl, isopropyl, n-butyl, 2-butyl or 2-methyl-2-butyl radical, x has a value of 1 to 30, k and j have values of 1 to 12 and preferably 1 to 5. Where x has a value of $\geqq 2$, each substituent $R^3$ in the above formula may be different. $R^1$ and $R^2$ are preferably linear or branched, saturated or unsaturated, aliphatic or aromatic hydrocarbon radicals containing 6 to 22 carbon atoms, radicals containing 8 to 18 carbon atoms being particularly preferred. For the substituent $R^3$, H, —$CH_3$ or —$CH_2CH_3$ are particularly preferred. Particularly preferred values for x are in the range from 1 to 20 and more particularly in the range from 6 to 15.

As mentioned above, each substituent $R^3$ in the above formula may be different where x is ≧2. In this way, the alkylene oxide unit in the square brackets can be varied. If, for example, x has a value of 3, the substituent $R^3$ may be selected to form ethylene oxide ($R^3$=H) or propylene oxide ($R^3$=$CH_3$) units which may be joined together in any order, for example (EO)(PO)(EO), (EO)(EO)(PO), (EO)(EO)(EO), (PO)(EO)(PO), (PO)(PO)(EO) and (PO)(PO)(PO). The value 3 for x was selected by way of example and may easily be larger, the range of variation increasing with increasing x-values and including, for example, a large number of (EO) groups combined with a small number of (PO) groups or vice versa.

Particularly preferred end-capped poly(oxyalkylated) alcohols corresponding to the above formula have values for both k and j of 1, so that the above formula can be simplified to:

$$R^1O[CH_2CH(R^3)O]_xCH_2CH(OH)CH_2OR^2$$

In this formula, $R^1$, $R^2$ and $R^3$ are as defined above and x has a value of 1 to 30, preferably 1 to 20 and more preferably 6 to 18. Surfactants in which the substituents $R^1$ and $R^2$ have 9 to 14 carbon atoms, $R^3$ stands for H and x has a value of 6 to 15 are particularly preferred.

To sum up what has just been stated, preferred detergents according to the invention contain end-capped poly (oxyalkylated) nonionic surfactants corresponding to the following formula:

$$R^1O[CH_2CH(R^3)O]_x[CH_2]_kCH(OH)[CH_2]_jOR^2$$

in which $R^1$ and $R^2$ are linear or branched, saturated or unsaturated, aliphatic or aromatic hydrocarbon radicals containing 1 to 30 carbon atoms, $R^3$ stands for H or for a methyl, ethyl, n-propyl, isopropyl, n-butyl, 2-butyl or 2-methyl-2-butyl radical, x has a value of 1 to 30, k and j have values of 1 to 12 and preferably 1 to 5,
surfactants of the following type:

$$R^1O[CH_2CH(R^3)O]_xCH_2CH(OH)CH_2OR^2$$

where x has a value of 1 to 30, preferably 1 to 20 and more preferably 6 to 18,
being particularly preferred.

Cationic and/or amphoteric surfactants may also be used instead of or together with the surfactants mentioned. To sum up, preferred detergents according to the invention are characterized in that they contain surfactant(s), preferably nonionic surfactant(s) and more particularly nonionic surfactant(s) from the group of alkoxylated alcohols, in quantities of 0.1 to 60% by weight, preferably 0.5 to 50% by weight, more preferably 1 to 40% by weight and most preferably 2 to 30% by weight, based on the detergent.

Besides the builders, substances from the group of surfactants (see above), bleaching agents, bleach activators, enzymes, polymers and dyes and perfumes are particularly important ingredients of detergents. Important representatives of these groups are described hereinafter.

Among the compounds yielding $H_2O_2$ in water which serve as bleaching agents, sodium perborate tetrahydrate and sodium perborate monohydrate are particularly important. Other useful bleaching agents are, for example, sodium percarbonate, peroxypyrophosphates, citrate perhydrates and $H_2O_2$-yielding peracidic salts or peracids, such as perbenzoates, peroxophthalates, diperazelaic acid, phthaloiminoperacid or diperdodecane dioic acid. Dishwasher detergents according to the invention may also contain bleaching agents from the group of organic bleaches. Typical organic bleaching agents are diacyl peroxides, such as dibenzoyl peroxide for example. Other typical organic bleaching agents are the peroxy acids, of which alkyl peroxy acids and aryl peroxy acids are particularly mentioned as examples. Preferred representatives are (a) peroxybenzoic acid and ring-substituted derivatives thereof, such as alkyl peroxybenzoic acids, but also peroxy-α-naphthoic acid and magnesium monoperphthalate, (b) aliphatic or substituted aliphatic peroxy acids, such as peroxylauric acid, peroxystearic acid, ε-phthalimidoperoxycaproic acid [phthaloiminoperoxyhexanoic acid (PAP)], o-carboxybenzamidoperoxycaproic acid, N-nonenylamidoperadipic acid and N-nonenylamidopersuccinates and (c) aliphatic and araliphatic peroxydicarboxylic acids, such as 1,12-diperoxycarboxylic acid, 1,9-diperoxyazelaic acid, diperoxysebacic acid, diperoxybrassylic acid, diperoxyphthalic acids, 2-decyldiperoxybutane-1,4-dioic acid, N,N-terephthaloyl-di(6-aminopercaproic acid).

Other suitable bleaching agents in the dishwasher detergents according to the invention are chlorine- and bromine-releasing substances. Suitable chlorine- or bromine-releasing materials are, for example, heterocyclic N-bromamides and N-chloramides, for example trichloroisocyanuric acid, tribromoisocyanuric acid, dibromoisocyanuric acid and/or dichloroisocyanuric acid (DICA) and/or salts thereof with cations, such as potassium and sodium. Hydantoin compounds, such as 1,3-dichloro-5,5-dimethyl hydantoin, are also suitable.

Bleach activators which support the effect of the bleaching agents are other important ingredients. Known bleach activators are compounds which contain one or more N- or O-acyl groups, such as substances from the class of anhydrides, esters, imides and acylated imidazoles or oximes. Examples are tetraacetyl ethylenediamine (TAED), tetraacetyl methylenediamine (TAMD) and tetraacetyl hexylenediamine (TAHD) and also pentaacetyl glucose (PAG), 1,5-diacetyl-2,2-dioxohexaydro-1,3,5-triazine (DADHT) and isatoic anhydride (ISA).

Suitable bleach activators are compounds which form aliphatic peroxocarboxylic acids containing preferably 1 to 10 carbon atoms and more preferably 2 to 4 carbon atoms and/or optionally substituted perbenzoic acid under perhydrolysis conditions. Substances bearing O- and/or N-acyl groups with the number of carbon atoms mentioned and/or optionally substituted benzoyl groups are suitable. Preferred bleach activators are polyacylated alkylenediamines, more particularly tetraacetyl ethylenediamine (TAED), acylated triazine derivatives, more particularly 1,5-diacetyl-2,4-dioxohexahydro-1,3,5-triazine (DADHT), acylated glycolurils, more particularly tetraacetyl glycoluril (TAGU), N-acylimides, more particularly N-nonanoyl succinimide (NOSI), acylated phenol sulfonates, more particularly n-nonanoyl- or isononanoyl-oxybenzenesulfonate (n- or iso-NOBS), carboxylic anhydrides, more particularly phthalic anhydride, acylated polyhydric alcohols, more particularly triacetin, ethylene glycol diacetate, 2,5-diacetoxy-2,5-dihydrofuran, n-methyl morpholinium acetonitrile methyl sulfate (MMA) and the enol esters known from German patent applications DE 196 16 693 and DE 196 16 767, acetylated sorbitol and mannitol and the mixtures thereof (SORMAN), acylated sugar derivatives, more particularly pentaacetyl glucose (PAG), pentaacetyl fructose, tetraacetyl xylose and octaacetyl lactose, and acetylated, optionally N-alkylated glucamine and gluconolactone, and/or N-acylated lactams, for example N-benzoyl caprolactam. Substituted hydrophilic acyl acetals and acyl lactams are also preferably used. Combinations of conventional bleach activators may also be used.

In addition to or instead of the conventional bleach activators mentioned above, so-called bleach catalysts may also be incorporated in the rinse agent particles. These substances are bleach-boosting transition metal salts or transition metal complexes such as, for example, manganese-, iron-, cobalt-, ruthenium- or molybdenum-salen or -carbonyl complexes. Manganese, iron, cobalt, ruthenium, molybdenum, titanium, vanadium and copper complexes with nitrogen-containing tripod ligands and cobalt-, iron-, copper- and ruthenium-ammine complexes may also be used as bleach catalysts.

Bleach activators from the group of polyacylated alkylenediamines, more particularly tetraacetyl ethylenediamine (TAED), N-acyl imides, more particularly N-nonanoyl succinimide (NOSI), acylated phenol sulfonates, more particularly n-nonanoyl- or isononanoyloxybenzenesulfonate (n- or iso-NOBS), n-methyl morpholinium acetonitrile methyl sulfate (MMA) are preferably used, preferably in quantities of up to 10% by weight, more preferably in quantities of 0.1% by weight to 8% by weight, most preferably in quantities of 2 to 8% by weight and, with particular advantage, in quantities of 2 to 6% by weight, based on the detergent as a whole.

Bleach-boosting transition metal complexes, more particularly containing the central atoms Mn, Fe, Co, Cu, Mo, V, Ti and/or Ru, preferably selected from the group of manganese and/or cobalt salts and/or complexes, more preferably the cobalt (ammine) complexes, cobalt (acetate) complexes, cobalt (carbonyl) complexes, chlorides of cobalt or manganese and manganese sulfate, are also present in typical quantities, preferably in a quantity of up to 5% by weight, more preferably in a quantity of 0.0025% by weight to 1% by weight and most preferably in a quantity of 0.01% by weight to 0.25% by weight, based on the detergent as a whole. In special cases, however, more bleach activator may even be used.

Enzymes suitable for use in the detergents according to the invention are, in particular, those from the classes of hydrolases, such as proteases, esterases, lipases or lipolytic enzymes, amylases, glycosyl hydrolases and mixtures thereof. All these hydrolases contribute to the removal of stains, such as protein-containing, fat-containing or starch-containing stains. Oxidoreductases may also be used for bleaching. Enzymes obtained from bacterial strains or fungi, such as *Bacillus subtilis, Bacillus licheniformis, Streptomyces griseus, Coprinus cinereus* and *Humicola insolens* and from genetically modified variants are particularly suitable. Proteases of the subtilisin type are preferably used, proteases obtained from *Bacillus lentus* being particularly preferred. Of particular interest in this regard are enzyme mixtures, for example of protease and amylase or protease and lipase or lipolytic enzymes or of protease, amylase and lipase or lipolytic enzymes or protease, lipase or lipolytic enzymes, but especially protease- and/or lipase-containing mixtures or mixtures with lipolytic enzymes. Examples of such lipolytic enzymes are the known cutinases. Peroxidases or oxidases have also been successfully used in some cases. Suitable amylases include in particular a-amylases, isoamylases, pullanases and pectinases.

The enzymes may be adsorbed to supports and/or encapsulated in membrane materials to protect them against premature decomposition. The percentage content of the enzymes, enzyme mixtures or enzyme granules may be, for example, from about 0.1 to 5% by weight and is preferably from 0.5 to about 4.5% by weight.

Dyes and perfumes may be added to the dishwasher detergents according in order to improve the aesthetic impression created by the products and to provide the consumer not only with the required performance but also with a visually and sensorially "typical and unmistakable" product. Suitable perfume oils or perfumes include individual perfume compounds, for example synthetic products of the ester, ether, aldehyde, ketone, alcohol and hydrocarbon type. Perfume compounds of the ester type are, for example, benzyl acetate, phenoxyethyl isobutyrate, p-tert.butyl cyclohexyl acetate, linalyl acetate, dimethyl benzyl carbinyl acetate, phenyl ethyl acetate, linalyl benzoate, benzyl formate, ethyl methyl phenyl glycinate, allyl cyclohexyl propionate, styrallyl propionate and benzyl salicylate. The ethers include, for example, benzyl ethyl ether; the aldehydes include, for example, the linear alkanals containing 8 to 18 carbon atoms, citral, citronellal, citronellyloxyacetaldehyde, cyclamen aldehyde, hydroxycitronellal, lilial and bourgeonal; the ketones include, for example, the ionones, α-isomethyl ionone and methyl cedryl ketone; the alcohols include anethol, citronellol, eugenol, geraniol, linalool, phenyl ethyl alcohol and terpineol and the hydrocarbons include, above all, the terpenes, such as limonene and pinene. However, mixtures of various perfumes which together produce an attractive perfume note are preferably used. Perfume oils such as these may also contain natural perfume mixtures obtainable from vegetable sources, for example pine, citrus, jasmine, patchouli, rose or ylang-ylang oil. Also suitable are clary oil, camomile oil, clove oil, melissa oil, mint oil, cinnamon leaf oil, lime blossom oil, juniper berry oil, vetivert oil, olibanum oil, galbanum oil and ladanum oil and orange blossom oil, neroli oil, orange peel oil and sandalwood oil.

The perfumes may be directly incorporated in the detergents according to the invention, although it can also be of advantage to apply the perfumes to supports which strengthen the adherence of the perfume to the washing and which provide the textiles with a long-lasting fragrance through a slower release of the perfume. Suitable support materials are, for example, cyclodextrins, the cyclodextrin/perfume complexes optionally being coated with other auxiliaries. The perfumes may also be incorporated in the rinse agent particles according to the invention which leads to a perfume impression when the machine is opened (see above)

In order to improve their aesthetic impression, the detergents according to the invention (or parts thereof) may be colored with suitable dyes. Preferred dyes, which are not difficult for the expert to choose, have high stability in storage, are not affected by the other ingredients of the detergents or by light and do not have any pronounced substantivity for the substrates to be treated with the detergents, such as glass, ceramics or plastic tableware, so as not to color them.

To protect the tableware or the machine itself, the detergents according to the invention may contain corrosion inhibitors, silver protectors being particularly important for dishwashing machines. Known corrosion inhibitors may be used. Above all, silver protectors selected from the group of triazoles, benzotriazoles, bisbenzotriazoles, aminotriazoles, alkylaminotriazoles and the transition metal salts or complexes may generally be used. Benzotriazole and/or alkylaminotriazole is/are particularly preferred. In addition, dishwashing formulations often contain corrosion inhibitors containing active chlorine which are capable of distinctly reducing the corrosion of silver surfaces. Chlorine-free dishwashing detergents contain in particular oxygen- and nitrogen-containing organic redox-active compounds, such as dihydric and trihydric phenols, for example hydroquinone, pyrocatechol, hydroxyhydroquinone, gallic acid, phloroglucinol, pyrogallol and derivatives of these compounds. Salt-like and complex-like inorganic compounds, such as salts of the metals Mn, Ti, Zr, Hf, V, Co and Ce are also frequently used. Of these, the transition metal salts selected from the group of manganese and/or cobalt salts and/or complexes are preferred, cobalt(ammine) complexes, cobalt(acetate) complexes, cobalt(carbonyl) complexes, chlorides of cobalt or manganese and manganese sulfate being particularly preferred. Zinc compounds may also be used to prevent corrosion of tableware.

As mentioned above, the detergents according to the invention may be made up in any desired form. Depending on the choice of the other ingredients and the "matrix", both liquid and solid detergents may readily be produced. In the case of liquid detergents, liquid dishwashing detergents with viscosities from a few Pas up to gel-form compositions or even cutting-resistant pastes can be produced. In the case of solid detergents, both particulate compositions, such as powders, granules, extrudates, flakes, pellets, etc., and compact shaped bodies, such as blocks or tablets, can be produced, tablets being distinctly preferred for their high consumer acceptance.

Dishwasher tablets can be produced from a single premix, i.e. as a single-phase tablet. However, several premixes differing in composition can be successively tabletted, resulting in the most simple case in layered tablets. Depending on the number of premixes, two-layer, three-layer or four-layer tablets are obtained. The various layers enable active ingredients to be separated from one another, i.e. the ingredients compulsorily present in accordance with the invention and other optional ingredients, such as bleaching agents and bleach activators for example, can be separated from one another According to the invention, the individual phases of the tablet can have different three-dimensional forms. The most simple embodiment is a two-layer or multilayer tablet in which each layer represents a phase. However, it is also possible in accordance with the invention to produce multiphase tablets in which individual phases assume the form of incorporations in (an)other phase(s). Besides so-called "ring/core" tablets, shell tablets, for example, or combinations of the embodiments mentioned are possible. Technically the most common three-dimensional form of a multiphase tablet is the two-layer or multi-layer tablet. According to the invention, therefore, the phases of the tablet preferably assume the form of layers and the tablet has two, three or four phases.

The tablets according to the invention may assume any geometric form, concave, convex, biconcave, biconvex, cubic, tetragonal, orthorhombic, cylindrical, spherical, cylinder-segment-like, disk-shaped, tetrahedral, dodecahedral, octahedral, conical, pyramidal, ellipsoidal, pentagonal-, heptagonal- and hexagonal-prismatic and rhombohedral forms being particularly preferred. Completely irregular bases, such as arrow and animal shapes, trees, clouds etc. can also be produced. If the tablets according to the invention have corners and edges, they are preferably rounded off. As an additional optical differentiation, an embodiment with rounded-off corners and bevelled ("chamfered") edges is preferred.

Another way of separating active ingredients in individual regions from one another is to produce a tablet with a cavity (for example a recess or a hole) and to fill this cavity with another part, for example with a melt or powder. A separately produced tablet or shaped body may also be stuck on or stuck in with an adhesive. Where certain geometric conditions are satisfied (mechanical adhesion), there is no need for adhesive. This variant has the advantage that the second part on the one hand can be produced in various ways (for example by tabletting, sintering, casting, extrusion, etc.) and, on the other hand, can be made up by suitable measures (for example by coating)—before being "fitted" in or on—in such a way that it dissolves and releases the ingredients at a predetermined time in the program sequence of the dishwashing machine.

The cavity in the compressed part of such tablets according to the invention may assume any shape. It may extend throughout the tablet, i.e. may have an opening on various sides, for example at the top and bottom of the tablet, although it may also be a cavity which does not extend throughout the tablet, i.e. a cavity of which the opening is only visible on one side of the tablet. The shape of the cavity can also be freely selected within wide limits. In the interests of process economy, holes which open on opposite sides of the tablets and recesses which open on one side only have proved successful. In preferred detergent tablets, the cavity is in the form of a hole opening on two opposite sides of the tablet. The shape of this hole may be freely selected, preferred tablets being characterized in that the hole has circular, ellipsoidal, triangular, rectangular, square, pentagonal, hexagonal, heptagonal or octagonal horizontal sections. The hole may also assume completely irregular shapes, such as arrow or animal shapes, trees, clouds, etc. As with the tablets, angular holes preferably have rounded-off corners and edges or rounded-off corners and chamfered edges are preferred.

The geometric forms mentioned above may be combined as required with one another. Thus, tablets with a rectangular or square base and circular holes can be produced just as well as round tablets with octagonal holes, the various combination possibilities being unlimited. In the interests of process economy and consumer acceptance, particularly preferred holed tablets are characterized in that the base of the tablet and the cross-section of the hole have the same geometric form, for example tablets with a square base and a centrally located square hole. Ring tablets, i.e. circular tablets with a circular hole, are particularly preferred.

If the above-mentioned principle of the hole open on two opposite sides of the tablet is reduced to one opening, the result is a recess tablet. Detergent tablets according to the invention in which the cavity assumes the form of a recess are also preferred. As with the "hole tablets", the tablets according to the invention in this embodiment, too, may assume any geometric form, concave, convex, biconcave, biconvex, cubic, tetragonal, orthorhombic, cylindrical, spherical, cylinder-segment-like, disk-shaped, tetrahedral, dodecahedral, octahedral, conical, pyramidal, ellipsoidal, pentagonal-, heptagonal- and octagonal-prismatic and rhombohedral forms being particularly preferred. The base of the tablet may even assume a completely irregular shape, such as arrow or animal shapes, trees, clouds, etc. If the tablet has corners and edges, they are preferably rounded-off. As an additional optical differentiation, an embodiment with rounded-off corners and chamfered ("bevelled") edges is preferred.

The shape of the recess may also be freely selected, tablets in which at least one recess may assume a concave, convex, cubic, tetragonal, orthorhombic, cylindrical, spherical, cylinder-segment-like, disk-shaped, tetrahedral, dodecahedral, octahedral, conical, pyramidal, ellipsoidal, pentagonal-, heptagonal- and hexagonal-prismatic and rhombohedral form being preferred. The recess may also assume a totally irregular shape, such as arrow or animal shapes, trees, clouds etc. As with the tablets, recesses with rounded-off corners and edges or with rounded-off corners and chamfered edges are preferred.

The size of the recess or the hole by comparison with the tablet as a whole is governed by the application envisaged for the tablets. The size of the cavity can vary according to whether it is to be filled with more active substance and whether a relatively small or relatively large quantity of active substance is intended to be present. Irrespective of the intended application, preferred detergent tablets are characterized in that the ratio by volume of the compressed part ("basic tablet") to the "core" is 2:1 to 100:1, preferably 3:1 to 80:1, more preferably 4:1 to 50:1 and most preferably 5:1 to 30:1.

Besides the ratio by volume mentioned, a ratio by weight between the two parts can also be stated, in which case the two value correlate with one another via the densities of the basic tablet or the "core". Irrespective of the density of the individual parts, preferred detergent tablets according to the invention are characterized in that the ratio by weight of basic tablet to "core" is 1:1 to 100:1, preferably 2:1 to 80:1, more preferably 3:1 to 50:1 and most preferably 4:1 to 30:1.

Similar observations may also be made on the surfaces which are visible from the basic tablet or from the "core". Here, preferred detergent tablets are characterized in that the surface of the "core" visible to the outside makes up 1 to 25%, preferably 2 to 20%, more preferably 3 to 15% and most preferably 4 to 10% of the total surface area of the tablet.

The core and the basic tablet are preferably colored for visual differentiation. Besides the visual differentiation, performance-related advantages can be obtained differences in the solubility of the various parts of the tablet. According to the invention, detergent tablets where the core dissolves more quickly than the basic tablet are preferred. By incorporating certain ingredients, it is possible on the one hand to accelerate the solubility of the cores; on the other hand, the release of certain ingredients from the cores can lead to advantages in the cleaning process.

Detergent tablets according to the invention where the core dissolves later in the wash program than the basic tablet are of course also preferred. Performance advantages from this delayed release can be achieved, for example, by the release of active ingredient(s) in later rinse cycles through a more slowly dissolving core. In machine dishwashing for example, other active ingredient(s) can be made available in the final rinse cycle through more slowly dissolving cores. The results of the final rinse can thus be improved by additional ingredients, such as nonionic surfactants, acidifying agents, soil release polymers, etc. Perfume can also readily be incorporated. The delayed release of perfume can eliminate the "alkali smell" often noticed when dishwashing machines are opened.

In preferred embodiments of the present invention, the basic tablet has a high specific gravity. According to the invention, preferred detergent tablets are characterized in that the basic tablet has a density above 1,000 $kgdm^{-3}$, preferably above 1,025 $kgdm^{-3}$, more preferably above 1,050 $kgdm^{-3}$ and most preferably above 1,100 $kgdm^{-3}$.

In order to facilitate the disintegration of heavily compacted tablets, disintegration aids, so-called tablet disintegrators, may be incorporated in the basic tablets to shorten their disintegration times. According to Römpp (9th Edition, Vol. 6, page 4440) and Voigt "*Lehrbuch der pharmazeutischen Technologie*" (6th Edition, 1987, pages 182–184), tablet disintegrators or disintegration accelerators are auxiliaries which promote the rapid disintegration of tablets in water or gastric juices and the release of the pharmaceuticals in an absorbable form.

These substances, which are also known as "disintegrators" by virtue of their effect, are capable of undergoing an increase in volume on contact with water so that, on the one hand, their own volume is increased (swelling) and, on the other hand, a pressure can be generated through the release of gases which causes the tablet to disintegrate into relatively small particles. Well-known disintegrators are, for example, carbonate/citric acid systems, although other organic acids may also be used. Swelling disintegration aids are, for example, synthetic polymers, such as polyvinyl pyrrolidone (PVP), or natural polymers and modified natural substances, such as cellulose and starch and derivatives thereof, alginates or casein derivatives.

Preferred detergent tablets contain 0.5 to 10% by weight, preferably 3 to 7% by weight and more preferably 4 to 6% by weight of one or more disintegration aids, based on the weight of the tablet. If only the basic tablet contains disintegration aids, the figures mentioned are based solely on the weight of the basic tablet. Where disintegration aids are incorporated in the detergent components according to the invention, they count as ingredient d).

According to the invention, preferred disintegrators are cellulose-based disintegrators, so that preferred detergent tablets contain a cellulose-based disintegrator in quantities of 0.5 to 10% by weight, preferably 3 to 7% by weight and more preferably 4 to 6% by weight. Pure cellulose has the formal empirical composition $(C_6H_{10}O_5)_n$ and, formally, is a β-1,4-polyacetal of cellobiose which, in turn, is made up of two molecules of glucose. Suitable celluloses consist of ca. 500 to 5000 glucose units and, accordingly, have average molecular weights of 50,000 to 500,000. According to the invention, cellulose derivatives obtainable from cellulose by polymer-analog reactions may also be used as cellulose-based disintegrators. These chemically modified celluloses include, for example, products of esterification or etherification reactions in which hydroxy hydrogen atoms have been substituted. However, celluloses in which the hydroxy groups have been replaced by functional groups that are not attached by an oxygen atom may also be used as cellulose derivatives. The group of cellulose derivatives includes, for example, alkali metal celluloses, carboxymethyl cellulose (CMC), cellulose esters and ethers and aminocelluloses. The cellulose derivatives mentioned are preferably not used on their own, but rather in the form of a mixture with cellulose as cellulose-based disintegrators. The content of cellulose derivatives in mixtures such as these is preferably below 50% by weight and more preferably below 20% by weight, based on the cellulose-based disintegrator. In one particularly preferred embodiment, pure cellulose free from cellulose derivatives is used as the cellulose-based disintegrator.

The cellulose used as disintegration aid is preferably not used in fine-particle form, but is converted into a coarser form, for example by granulation or compacting, before it is added to and mixed with the premixes to be tabletted. The particle sizes of such disintegration aids is mostly above 200 μm, preferably at least 90% by weight of the particles being between 300 and 1600 μm in size and, more particularly, between 400 and 1200 μm in size. According to the invention, the above-described relatively coarse-particle cellulose-based disintegrators described in detail in the cited patent applications are preferably used as disintegration aids and are commercially obtainable, for example under the name of Arbocel® TF-30-HG from Rettenmaier.

Microcrystalline cellulose may be used as another cellulose-based disintegration aid or as part of such a component. This microcrystalline cellulose is obtained by partial hydrolysis of the celluloses under conditions which only attack and completely dissolve the amorphous regions (ca. 30% of the total cellulose mass) of the celluloses, but leave the crystalline regions (ca. 70%) undamaged. Subsequent de-aggregation of the microfine celluloses formed by hydrolysis provides the microcrystalline celluloses which have primary particle sizes of ca. 5 $\mu$m and which can be compacted, for example, to granules with a mean particle size of 200 $\mu$m.

According to the invention, preferred detergent tablets additionally contain a disintegration aid, preferably a cellulose-based disintegration aid, preferably in granular, co-granulated or compacted form, in quantities of 0.5 to 10% by weight, preferably in quantities of 3 to 7% by weight and more preferably in quantities of 4 to 6% by weight, based on tablet weight.

The detergent tablets according to the invention may additionally a gas-evolving effervescent system both in the basic tablet and in the cavity. The gas-evolving effervescent system may consist of a single substance which releases a gas on contact with water. Among these compounds, particular mention is made of magnesium peroxide which releases oxygen on contact with water. However, the gas-releasing effervescent system normally consists of at least two constituents which react with one another to form a gas. Although various possible systems could be used, for example systems releasing nitrogen, oxygen or hydrogen, the effervescent system used in the detergent tablets according to the invention should be selected with both economic and ecological considerations in mind. Preferred effervescent systems consist of alkali metal carbonate and/or hydrogen carbonate and an acidifying agent which is capable of releasing carbon dioxide from the alkali metal salts in aqueous solution.

Among the alkali metal carbonates and hydrogen carbonates, the sodium and potassium salts are preferred to the other salts for reasons of cost. The pure alkali metal carbonates and hydrogen carbonates do not of course have to be used, instead mixtures of different carbonates and hydrogen carbonates may be preferred.

In preferred detergent tablets, 2 to 20% by weight, preferably 3 to 15% by weight and more preferably 5 to 10% by weight of an alkali metal carbonate or hydrogen carbonate and 1 to 15% by weight, preferably 2 to 12% by weight and more preferably 3 to 10% by weight of an acidifying agent, based on the tablet as a whole, are used as the effervescent system.

Suitable acidifying agents which release carbon dioxide from the alkali metal salts in aqueous solution are, for example, boric acid and alkali metal hydrogen sulfates, alkali metal dihydrogen phosphates and other inorganic salts. However, organic acidifying agents are preferably used, citric acid being a particularly preferred acidifying agent. However, other solid mono-, oligo- and polycarboxylic acids in particular may also be used. Within the group, tartaric acid, succinic acid, malonic acid, adipic acid, maleic acid, fumaric acid, oxalic acid and polyacrylic acid are preferred. Organic sulfonic acids, such as amidosulfonic acid, may also be used. Sokalan® DCS (trademark of BASF), a mixture of succinic acid (max. 31% by weight), glutaric acid (max. 50% by weight) and adipic acid (max. 33% by weight), is commercially obtainable and may also be used with advantage as an acidifying agent for the purposes of the present invention.

According to the invention, preferred detergent tablets are those in which a substance selected from the group of organic di-, tri- and oligocarboxylic acids or mixtures thereof is present as the acidifying agent in the effervescent system.

What is claimed is:

1. A dishwasher detergent comprising:

a) 1% to 94.9% by weight of one or more builders;

b) 0.1% to 70% by weight of copolymers of:
i) unsaturated carboxylic acids;
ii) monomers containing sulfonic acid groups; and
iii) optionally other ionic or nonionic monomers;

c) 7.5% to 30% by weight of one or more nonionic surfactants; and d) 3% to 10% by weight of one or more homo- and/or copolymeric polycarboxylic acids or salts thereof.

2. A dishwasher detergent comprising:

a) 1% to 98.8% by weight of one or more builders;

b) 0.1% to 70% by weight copolymers of:
i) unsaturated carboxylic acids;
ii) monomers containing sulfonic acid groups; and
iii) optionally other ionic or nonionic monomers; and c) 3% to 10% by weight of one or more homo- and/or copolymeric polycarboxylic acids or salts thereof selected from the group consisting of alkali metal salts of polyacrylic acid or polymethacrylic acid with a relative molecular weight of 500 to 70,000 g/mol and copolymeric polycarboxylates with a relative molecular weight, based on free acids, of 2,000 to 70,000 g/mol.

3. The detergent of claim 2, wherein the copolymeric polycarboxylates comprise a copolymers of acrylic acid with methacrylic acid and/or a copolymer of acrylic acid or methacrylic acid with maleic acid.

4. The detergent of claim 3, wherein the copolymeric polycarboxylates comprise copolymers of acrylic acid with maleic acid which contain 50% to 90% by weight acrylic acid and 50% to 10% by weight maleic acid.

5. A dishwasher detergent comprising:

a) 1% to 93.8% by weight of one or more builders;

b) 0.1% to 70% by weight copolymers of:
i) unsaturated carboxylic acids;
ii) monomers containing sulfonic acid groups;
iii) optionally other ionic or nonionic nonomers;

c) 3% to 10% by weight of one or more homo- and/or copolymeric polycarboxylic acids or salts thereof; and d) 5% to 30% by weight of one or more nonionic surfactants.

6. The detergent of claim 1, wherein the copolymers b) comprise one or more structural units of formulae (III), (IV), (V), (VI), (VII), or (VIII):

$$-[CH_2-CHCOOH]_m-[CH_2-CHC(O)-Y-SO_3H]_p- \quad (III)$$

$$-[CH_2-CHCOOH]_m-[CH_2-CHC(O)-Y-SO_3H]_p- \quad (IV)$$

$$-[CH_2-CHCOOH]_m-[CH_2-C(CH_3)C(O)-Y-SO_3H]_p- \quad (V),$$

$$-[CH_2-C(CH_3)COOH]_m-[CH_2-C(CH_3)C(O)-Y-SO_3H]_p- \quad (VI)$$

$$-[HOOCCH-CHCOOH]_m-[CH_2-CHC(O)-Y-SO_3H]_p- \quad (VII)$$

$$-[HOOCCH-CHCOOH]_m-[CH_2-C(CH_3)C(O)O-Y-SO_3H]_p- \quad (VIII)$$

in which m and p are whole natural numbers of 1 to 2,000 and Y is a substituted or unsubstituted aliphatic, aromatic or araliphatic hydrocarbon radical spacer group containing 1 to 24 carbon atoms.

7. The detergent of claim 6, wherein Y represents —O—$(CH_2)_n$— with n=1 to 4, —O—$(C_6H_4)$—, —NH—$C(CH_3)_2$—; or —NH—$CH(CH_2CH_3)$—.

8. The detergent of claim 2, comprising homo- and/or copolymers of acrylic acid and/or methacrylic acid and/or maleic acid as homo- and/or copolymeric polycarboxylic acids or salts thereof.

9. The detergent of claim 2, wherein b) and c) are present in a weight ratio of 100:1 to 1:100.

10. The detergent of claim 2, wherein b) and c) are present in a weight ratio of 25:1 to 1:50.

11. The detergent of claim 10, wheren b) and c) are present in a weight ratio of 10:1 to 1:25.

12. The detergent of claim 11, wherein b) and c) are present in a weight ratio of 5:1 to 1:10.

13. The detergent of claim 2, wherein the copolymers b) comprise one or more structural units of formulae (III), (IV), (V), (VI), (VII), or (VIII):

$$—[CH_2—CHCOOH]_m—[CH_2—CHC(O)—Y—SO_3H]_p— \quad (III)$$

$$—[CH_2—CHCOOH]_m—[CH_2—CHC(O)—Y—SO_3H]_p— \quad (IV)$$

$$—[CH_2—CHCOOH]_m—[CH_2—C(CH_3)C(O)—Y—SO_3H]_p— \quad (V),$$

$$—[CH_2—C(CH_3)COOH]_m—[CH_2—C(CH_3)C(O)—Y—SO_3H]_p— \quad (VI)$$

$$—[HOOCCH—CHCOOH]_m—[CH_2—CHC(O)—Y—SO_3H]_p— \quad (VII)$$

$$—[HOOCCH—CHCOOH]_m—[CH_2—C(CH_3)C(O)O—Y—SO_3H]_p— \quad (VIII)$$

in which m and p are whole natural numbers of 1 to 2,000 and Y is a substituted or unsubstituted aliphatic, aromatic or araliphatic hydrocarbon radical spacer group containing 1 to 24 carbon atoms.

14. The detergent of claim 13, wherein Y represents —O—$(CH_2)_n$— with n=1 to 4, —O—$(C_6H_4)$—, —NH—$C(CH_3)_2$13 ; or —NH—$CH(CH_2CH_3)$—.

15. The detergent of claim 5, wherein the copoymers b) comprise one or more structural units of formulae (III), (IV), (V), (VI), (VII), or (VIII):

$$—[CH_2—CHCOOH]_m—[CH_2—CHC(O)—Y—SO_3H]_p— \quad (III)$$

$$—[CH_2—CHCOOH]_m—[CH_2—CHC(O)—Y—SO_3H]_p— \quad (IV)$$

$$—[CH_2—(CH_3)COOH]_m—[CH_2—C(CH_3)C(O)—Y—SO_3H]_p— \quad (VI)$$

$$—[CH_2—CHCOOH]_m—[CH_2—C(CH_3)C(O)—Y—SO_3H]_p— \quad (V),$$

$$—[HOOCCH—CHCOOH]_m—[CH_2—CHC(O)—Y—SO_3H]_p— \quad (VII)$$

$$—[HOOCCH—CHCOOH]_m—[CH_2—C(CH_3)C(O)O—Y—SO_3H]_p— \quad (VIII)$$

in which m and p are whole natural numbers of 1 to 2,000 and Y is a substituted or unsubstituted aliphatic, aromatic or araliphatic hydrocarbon radical spacer group containing 1 to 24 carbon atoms.

16. The detergent of claim 15, wherein Y represents —O—$(CH_2)_n$— with n=1 to 4, —O—$(C_6H_4)$—, —NH—$C(CH_3)_2$—; or —NH—$CH(CH_2CH_3)$—.

17. The detergent of claim 5, comprising homo- and/or copolymers of acrylic acid and/or methacrylic acid and/or maleic acid as homo- and/or copolymeric polycarboxylic acids or salts thereof.

18. The detergent of claim 5, wherein b) and c) are present in a weight ratio of 100:1 to 1:100.

19. The detergent of claim 18, wherein b) and c) are present in a weight ratio of 25:1 to 1:50.

20. The detergent of claim 19, wherein b) and c) are present in a weight ratio of 10:1 to 1:25.

21. The detergent of claim 20, wherein b) and c) are present in a weight ratio of 5:1 to 1:10.

22. The detergent of claim 1, further comprising one or more substances selected from the group consisting of acidifying agents, chelating agents, and bloom-inhibiting polymers.

23. The detergent of claim 2, further comprising one or more substances selected from the group consisting of acidifying agents, chelating agents, and bloom-inhibiting polymers.

24. The detergent of claim 5, further comprising one or more substances selected from the group consisting of acidifying agents, chelating agents, and bloom-inhibiting polymers.

25. The detergent of claim 13, wherein b) and c) are present in a weight ratio of 100:1 to 1:100.

26. The detergent of claim 15, wherein b) and c) are present in a weight ratio of 100:1 to 1:100.

27. The detergent of claim 1, comprising 7.5% to 25% by weight of the nonionic surfactant(s) c).

28. The detergent of claim 27, comprising 7.5% to 22.5% by weight of the nonionic surfactant(s) c).

29. The detergent of claim 28, comprising 7.5% to 20% by weight of the nonionic surfactants(s) c).

30. The detergent of claim 29, comprising 8% to 17.5% by weight of the nonionic surfactant(s) c).

31. The detergent of claim 5, comprising 5% to 25% by weight of the nonionic surfactant(s) d).

32. The detergent of claim 31, comprising 6% to 22.5% by weight of the nonionic surfactant(s) d).

33. The detergent of claim 32, comprising 7.5% to 20% by weight of the nonionic surfactant(s) d).

34. The detergent of claim 33, comprising 8% to 17.5% by weight of the nonionic surfactant(s) d).

35. The detergent of claim 1, comprising 0.25% to 50% by weight of the copolymer(s) b).

36. The detergent of claim 35, comprising 0.5% to 35% by weight of the copolymer(s) b).

37. The detergent of claim 36, comprising 0.75% to 20% by weight of the copolymer(s) b).

38. The detergent of claim 37, comprising 1% to 15% by weight of the copolymer(s) b).

39. The detergent of claim 6, comprising 0.25% to 50% by weight of the copolymer(s) b).

40. The detergent of claim 27, comprising 0.25% to 50% by weight of the copolymer(s) b).

41. The detergent of claim 2, comprising 0.25% to 50% by weight of the copolymer(s) b).

42. The detergent of claim 41, comprising 0.5% to 35% by weight of the copolymer(s) b).

43. The detergent of claim 42, comprising 0.75% to 20% by weight of the copolymer(s) b).

44. The detergent of claim 43, comprising 1% to 15% by weight of the copolymer(s) b).

45. The detergent of claim 9, comprising 0.25% to 50% by weight of the copolymer(s) b).

46. The detergent of claim 13, comprising 0.25% to 50% by weight of the copolymer(s) b).

47. The detergent of claim 5, comprising 0.25% to 50% by weight of the copolymer(s) b).

48. The detergent of claim 47, comprising 0.5% to 35% by weight of the copolymer(s) b).

49. The detergent of claim 48, comprising 0.75% to 20% by weight of the copolymer(s) b).

50. The detergent of claim 49, comprising 1% to 15% by weight of the copolymer(s) b).

51. The detergent of claim 15, comprising 0.25% to 50% by weight of the copolymer(s) b).

52. The detergent of claim 18, comprising 0.25% to 50% by weight of the copolymer(s) b).

* * * * *